US011279455B1

(12) United States Patent
Adams

(10) Patent No.: US 11,279,455 B1
(45) Date of Patent: Mar. 22, 2022

(54) COUNTERMEASURES APPARATUS AND METHOD

(71) Applicant: Richard D. Adams, Madison, AL (US)

(72) Inventor: Richard D. Adams, Madison, AL (US)

( * ) Notice: Subject to any disclaimer, the term of this patent is extended or adjusted under 35 U.S.C. 154(b) by 22 days.

(21) Appl. No.: 16/923,035

(22) Filed: Jul. 7, 2020

Related U.S. Application Data

(62) Division of application No. 16/231,392, filed on Dec. 22, 2018, now Pat. No. 10,703,451.

(51) Int. Cl.
*F41H 11/00* (2006.01)
*B63G 9/02* (2006.01)

(52) U.S. Cl.
CPC ..... *B63G 9/02* (2013.01); *F41H 11/00* (2013.01)

(58) Field of Classification Search
CPC ..... F41H 11/02; F41H 11/00
USPC ..... 89/1.11
See application file for complete search history.

(56) References Cited

U.S. PATENT DOCUMENTS 5,583,311 A * 12/1996 Rieger ..... F41H 11/04 102/405
7,882,775 B2 * 2/2011 Martinez ..... F42B 23/10 89/1.34

* cited by examiner

*Primary Examiner* — Reginald S Tillman, Jr.
(74) *Attorney, Agent, or Firm* — Mark Clodfelter

(57) ABSTRACT

A method for countering an oncoming threat is disclosed. A location in front of the threat is selected, and a generally spherical volume is defined by a plurality of lines deployed from a centrally located communications unit. Sensors associated with the lines are connected to the communications unit and sense presence of the oncoming threat, whereupon countermeasures are activated responsive to the sensed oncoming threat.

19 Claims, 23 Drawing Sheets

COUNTERMEASURES APPARATUS AND METHOD

CROSS REFERENCE TO RELATED APPLICATIONS

This application is a divisional application of Applicant's US pending patent application Ser. No. 16/231,392, filed Dec. 22, 2018, issued as U.S. Pat. No. 10,703,451 on Jul. 7, 2020, and which is incorporated by reference herein in its entirety.

FIELD OF THE INVENTION

This invention relates generally to countermeasures against guided or unguided hostile projectile attacks, such as torpedoes, and more particularly to a primary countermeasure device from which a plurality of tow projectiles that each tow a line or support structure are deployed, the lines carrying any of a plurality of sensor arrays, explosive charges or radiating countermeasures for disrupting or destroying such hostile projectiles.

BACKGROUND OF THE INVENTION

Defensive systems and countermeasures are critical to the survival of military and possibly to other ocean-going surface and subsurface platforms such as oil wells, drilling platforms and others. Current and future threats, such as from torpedoes, underwater rockets, mines and so forth have, and will have the ability to counter many defensive countermeasure systems that are deployed by surface and subsurface vehicles. Though there have been a multitude of systems designed to counter torpedoes over the years, such as U.S. Pat. Nos. 1,195,042, 3,875,844, and others, most, if not all, of these countermeasure systems are outdated with respect to current threats. The speed and sophistication of current torpedoes make most of the past anti-torpedo systems obsolete as most systems that use sensors to counter an underwater threat, such as Hagelberg and Lobitz's anti-ship torpedo defense missile (U.S. Pat. No. 4,215,630) can be countered in turn by countermeasure systems onboard a torpedo. This is relevant where a threat countermeasures such as in Hagelberg and Lobitz uses active sonar that can be detected by an oncoming threat. In addition, since a wake homing torpedo follows a zigzag path through the wake of a fleeing vessel, there is no assurance that such an oncoming threat will encounter or come sufficiently close to the explosive device of Hagelberg and Lobitz, which has a destructive range of only about 20 feet. Other counter threat systems, such as Lavan's (U.S. Pat. No. 5,069,109) and Longerich (U.S. Pat. No. 4,262,595) do deploy a solid anti-torpedo object (net) to interfere with a threat torpedo but would be slow to deploy since they have no means of assistance to spread the net to its full deployment width. This is critical when going up against current supercavitating torpedoes that can travel in excess of 200 knots (about 220 miles per hour), which will cover a range of 10 miles in about 2.75 minutes or less, and may simply penetrate a net due to their mass and speed. Systems that deploy nets will also cause significant damage to sea-life as well as other friendly surface and subsurface vehicles. Another deficit of large nets are that they are heavy and require larger and more powerful delivery vehicles. The current invention overcomes these shortcomings by having embodiments that rapidly deploy an array or field of lines that may carry explosives, sensors or other elements to form a partially physical barrier that can counter fast moving underwater threats such as torpedoes.

SUMMARY OF THE INVENTION

In accordance with the present invention, a ballistically delivered anti-torpedo, projectile and underwater vehicle countermeasures apparatus can be launched from an air vehicle, surface vehicle or sub-surface vehicle. The device includes one or more neutrally buoyant, generally spherical communications and control orb-shaped devices designed to be released by a propulsion and delivery vehicle in the path of an incoming underwater threat, and after being deployed, the orb/orbs each deploy line deployment mechanisms, which in some embodiments may be miniature propulsion devices, such as microrockets or engine/screw propulsion devices, each such device towing a respective line attached to the orb so that the lines generally fill a spherical volume or plane around a respective orb. In some embodiments, at least some of the lines incorporate stiffeners to assist in maintaining the lines position and orientations in the water The extended lines may be equipped with or have attached thereto counter-torpedo sensors, antenna, transducers, explosives or other means to destroy, disable or jam sensors of an incoming torpedo, mine or other threat. Once a countermeasures orb has been deployed and is in its operational state with all of its lines extended, the orb with extended lines may passively wait for the presence of the threat or use transducers for broadcasting countermeasures. The system may also detect changes or signatures in the water indicative of an approaching threat, such as magnetic changes, rapid change in temperature, rapid change in surrounding water pressure, and changes of sound, or acoustic signatures, in a vicinity of the orb or within the spherical volume defined by the lines. In some embodiments, once the orb detects an anomaly associated with a threat, as by acoustic detection, the orb and its lines may initially, while the threat is at a longer range but within range of the orb's sensors, emit jamming or countermeasures signals such as strong electromagnetic signals, such as from an electrical current source, electrical signals or acoustic or other submarine signatures to disable or fool homing circuitry and serve as a decoy to interfere with communications of a wire guided torpedo. As the torpedo enters a volume defined by the lines extending from an orb, the orb may cause the lines to emit strong electrical potentials or currents to disable or destroy sensors of the torpedo, or in some embodiments the orb and sensor lines would explode when a torpedo is just outside or within the volume defined by the lines. As should be apparent, multiple orbs may be deployed in front of an unknown incoming torpedo or similar threat, each having the same or different countermeasure functions and configured to work separately, or several orbs may be networked to function together as a neural net. Some embodiments of this invention could incorporate guidance systems to guide countermeasure orbs to a specific location in front of a threat. Other embodiments employed as sensor systems would simply go a preset distance or to a predetermined location and wait to detect signals. Additional embodiments could also use the propulsion and delivery system to deliver multiple payloads, such as jammers, threat monitors, surveillance sensors, and mines. A self-destruct mechanism may be employed that is time delayed so as to not leave a destructive payload operational indefinitely. One embodiment of the invention could be used for satellite countermeasure protection in space to counter anti-satellite missiles or similar projectiles. Similarly, military aircraft may use a similar defensive embodiment at very short range such as when an air-to-air missile is about to strike an aircraft.

DETAILED DESCRIPTION OF THE DRAWINGS

Figure 1:
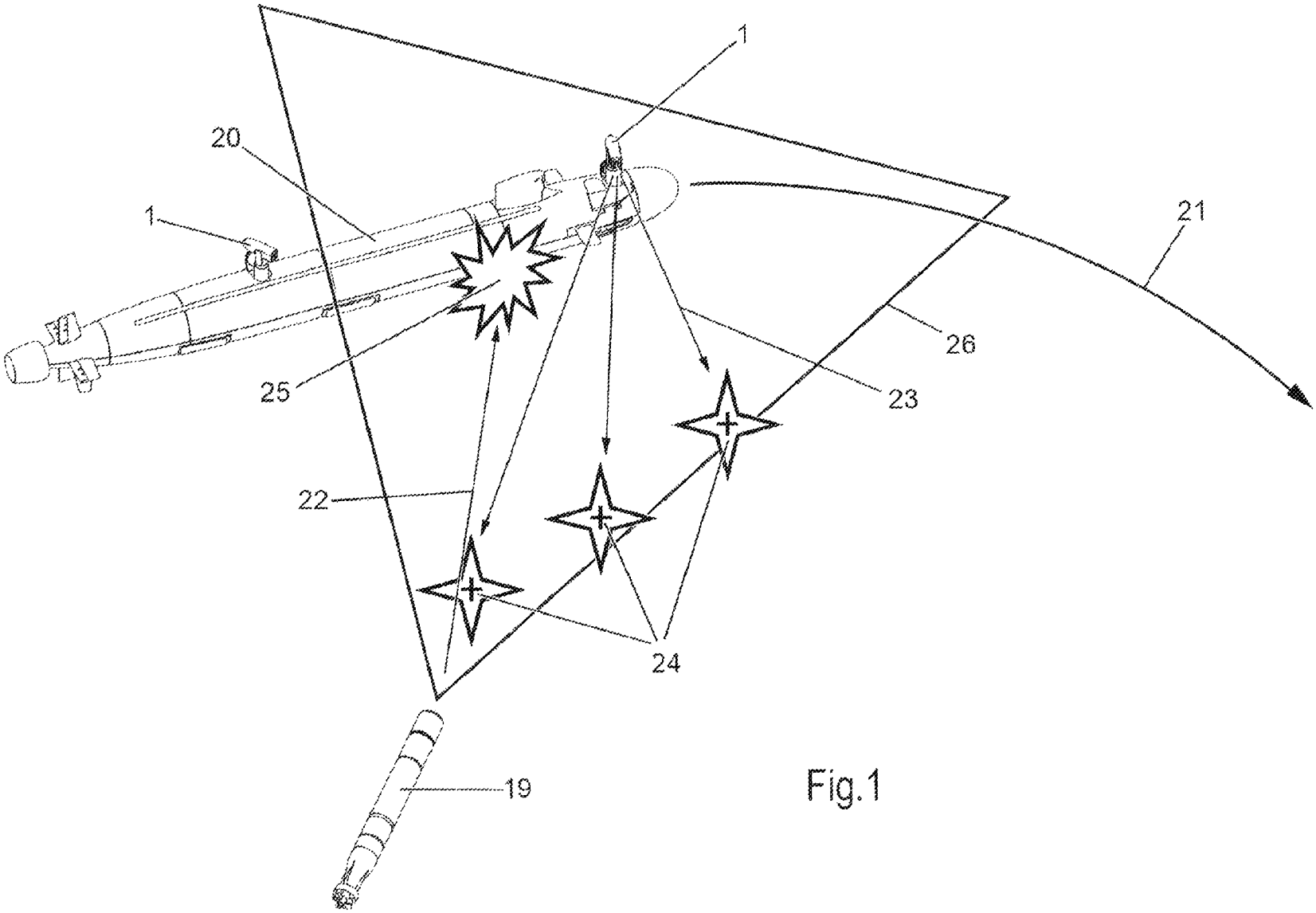
FIG. 1 is a diagrammatic view of a threat such as a torpedo about to enter an envelope within which countermeasures of the invention may be deployed.
Figure 2:
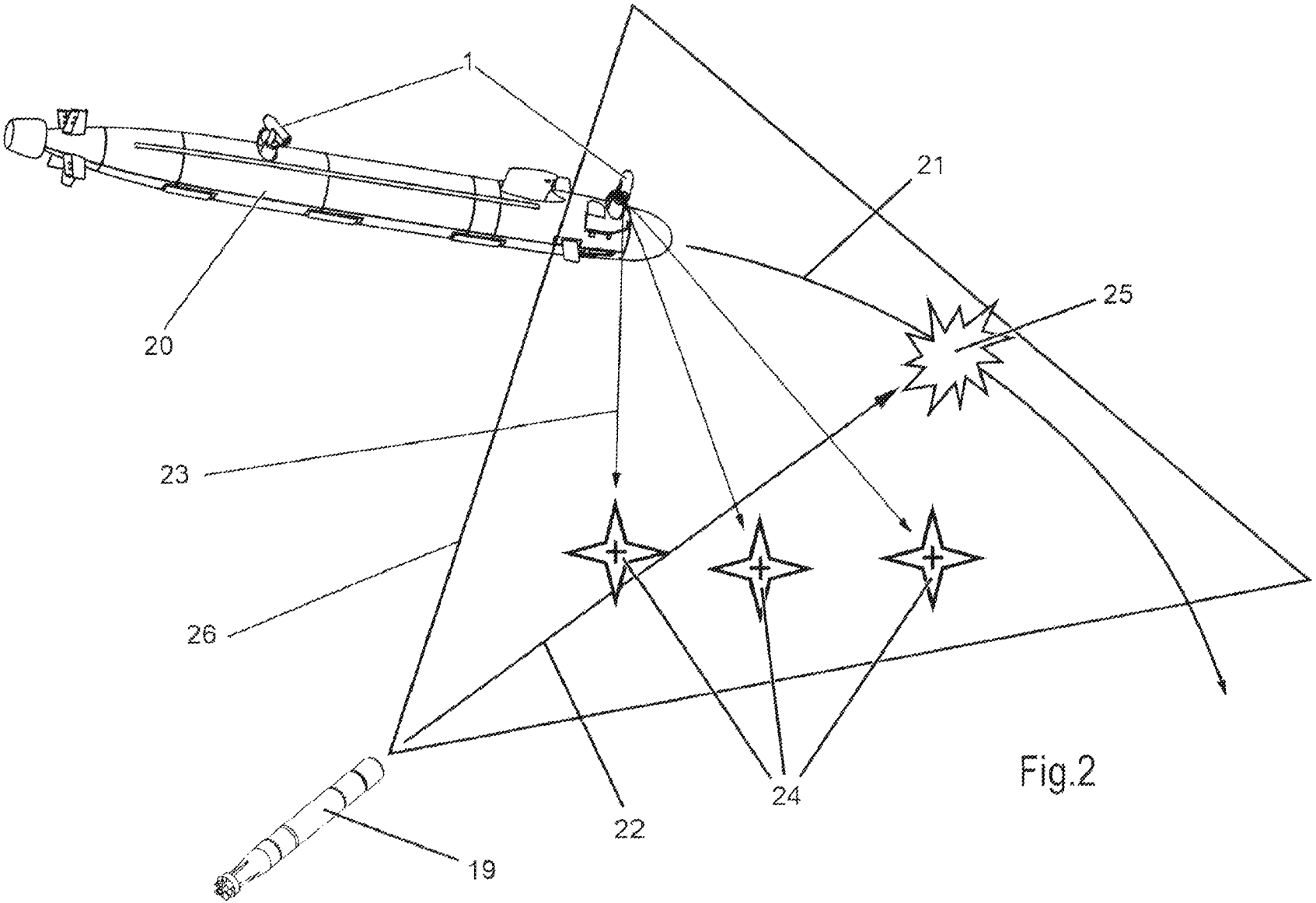
FIG. 2 is another diagrammatic view of the threat envelope within which countermeasures may be deployed.

Referring to FIGS. 1 and 2, a submarine 20 that is under attack by a torpedo 19 is shown, the torpedo 19 launched by any type of threat vehicle (not seen in drawing) with the intention of destroying the submarine 20. The submarine's internal threat detection and identification system, along with Applicant's countermeasures launch system 1 and integral threat detection and identification system, is used to counter torpedo 19. When a submarine or any other underwater or surface vehicle equipped with the instant invention encounters a threat (enemy torpedo/threat 19) within a threat sensor envelope 26, launch system 1 may be activated and directed to launch countermeasure systems 100 (FIG. 5) to locations 24 in front of the threat via paths 23. When used underwater, a volume encompassed by countermeasures system 100, e.g. when the lines are fully extended, may have a spherical diameter of from about 50-200 feet or more, depending on tactical requirements, function and allowable size of a body of Applicant's countermeasures device, which may be an orb, and as noted may be deployed in front of an incoming threat in order to disable or destroy the threat. A spherical volume is used because such a spherical volume will offer sensing and protection from any direction, as opposed to a generally planar array of sensors and countermeasures, which may not be as effective if a threat approaches in the plane of a planar countermeasures array of lines. Also, a planar system is harder to position or orient perpendicular to an oncoming threat, while this is of no concern with respect to a spherical system. In addition, processing requirements for determining when and where a threat has entered the spherical volume of an orb are reduced because all that is required is to sense differences in sound amplitude, magnetic fields or other emissions presented by a threat in the different lines of an orb. An existing threat detection and identification system (not shown) that currently exist in submarines may be configured to activate and launch one or more counter-torpedo system directly in the path of the incoming threat, as depicted in FIG. 1. While a spherical orb is disclosed, a body of the countermeasures system may be of any convenient, such as cylindrical body. One or both ends of the cylindrical body may be tapered, as for streamlining. In such cylindrical embodiments, a length of the cylinder may generally be up to 3 times the diameter of the body not counting the tapered ends.

FIG. 2 depicts another use or embodiment of the counter-torpedo system, which embodiment would either use an existing on-board threat detection system of a submarine, or as with this example, a threat detection system integrated with the instant invention.

FIGS. 1 and 2 show a calculated path 22 of the threat, as well as knowing the submarine's 20 intended path 21, and countermeasure systems 100 (FIG. 5) are deployed from the launch system 1 to intercept the enemy torpedo/threat 19 based on a threat envelope 26 in order to prevent the threat detonation 25 from being near the submarine 20. In some embodiments it is anticipated that countermeasures system 100 be deployed at least 50-500 yards or more from a submarine in order for the submarine to be protected from significant damage due to a conventional explosive warhead. This estimate is derived from studies just after WWII that showed that a 600 lb warhead of TNT would deform a pressure hull of a submarine if detonated at about 60 feet away at a shallow depth of less than 100 feet. The reason for such a short range of the explosion is due to the fact that most damage to a submarine from an underwater explosion occurs when the steam bubble developed by the explosion touches the hull of the submarine. The force of the steam bubble, when it touches the hull, forces water away from the hull of the submarine, after which the bubble collapses, and the inrushing water pounds against the hull of the sub, weakening the hull to the point of failure. The steam bubble may also oscillate, repeatedly pounding against the hull. In addition, there are damaging effects due to overpressure, or a shock wave, of the explosion. Since the damaging range from an explosion increases with depth due to increasing water pressure, increases in minimum deployment distance of countermeasures 100 may need to be at least out to 200-300 yards or more at deeper depths where a torpedo threat is from a large torpedo in order to avoid damage from the shock wave. In other embodiments, the countermeasures system/systems would be deployed further from the submarine or at intervals out to about 500 yards or 600 yards or more depending on how rapidly the countermeasures systems can be towed or otherwise deployed into deployment position relative to the oncoming threat.

Figure 2A:
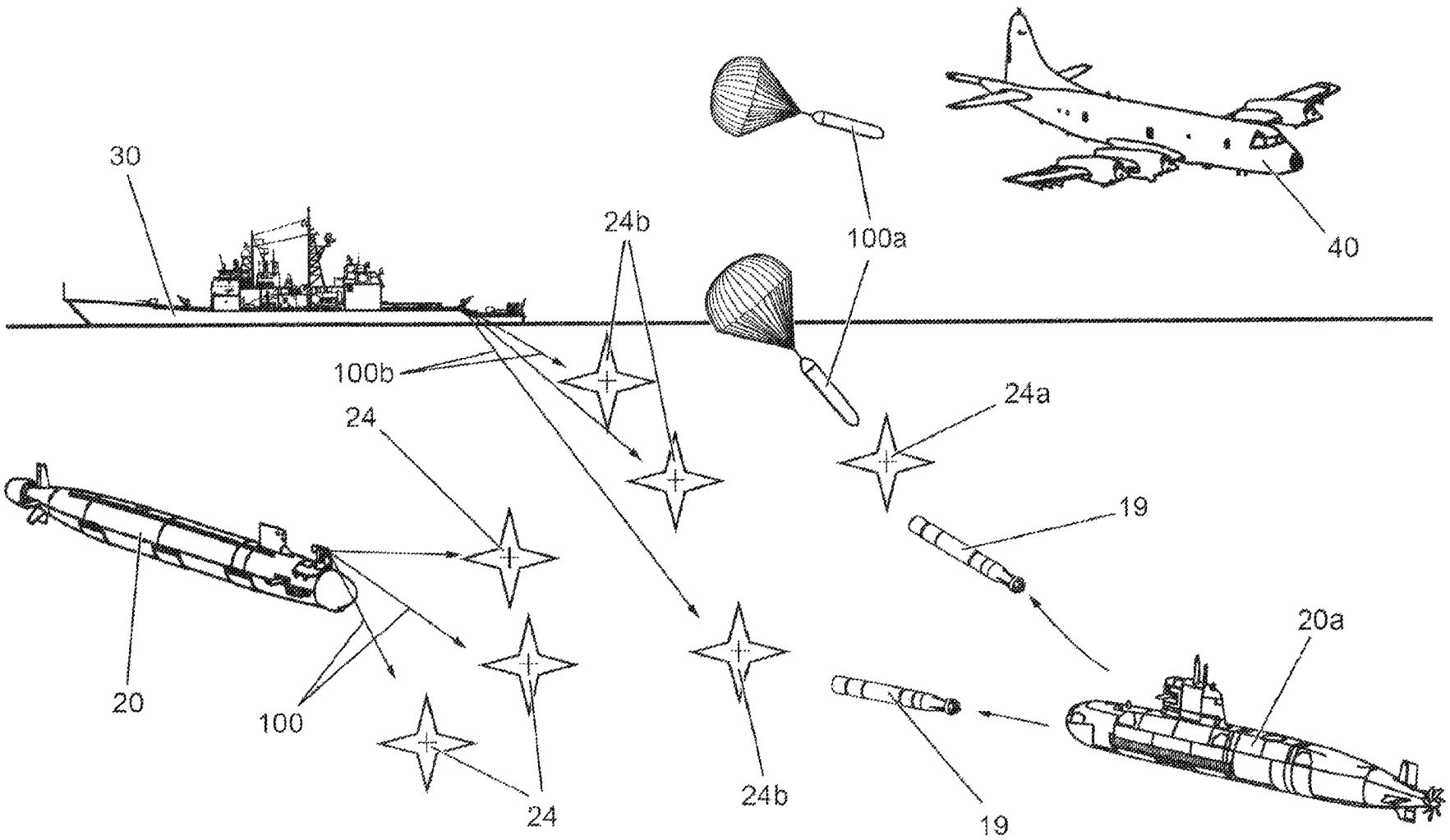
FIG. 2A shows methods by which countermeasures of the invention may be deployed.

FIG. 2A depicts multiple scenarios (embodiments) for the deployment of the counter-torpedo system. One embodiment is the deployment of the countermeasures system from a submarine 20, protecting itself from an enemy submarine 20*a* that has launched enemy torpedoes/threats 19 by deployment of the countermeasures system 100 to deployment area 24. Another deployment embodiment depicts a ship 30 deploying ship-deployed countermeasures systems 100*b* to deployment areas 24*b* to intercept the enemy torpedoes/threats 19. Another embodiment of deployment shows an aircraft 40 deploying the air-dropped countermeasures system 100*a* to a deployment area 24*a* to intercept the enemy torpedo/threat 19 to protect the ship 30, the submarine 20, or other friendly assets (not shown). In similar embodiments, an anti-threat orb may be propelled from the deck of a ship, as by a rocket, mechanical thrower or explosive charge similar to a mortar or depth charge, to an area in front of an oncoming threat. In these embodiments, the orb would be configured to sink to and be maintained at a predetermined depth, as by mechanisms well known in the art, nominally in front of the threat, before becoming fully active.

Figure 3:
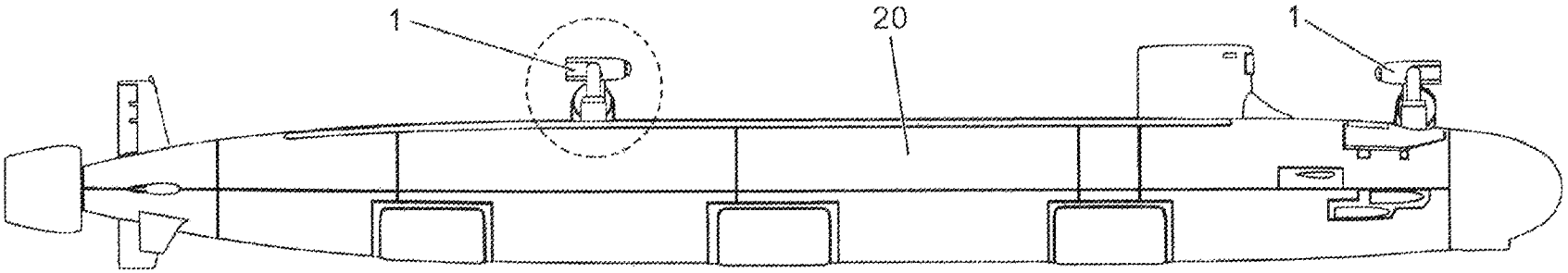
FIG. 3 is a diagrammatic view of a submarine having launch tubes holding countermeasures of the invention thereon.
Figure 4:
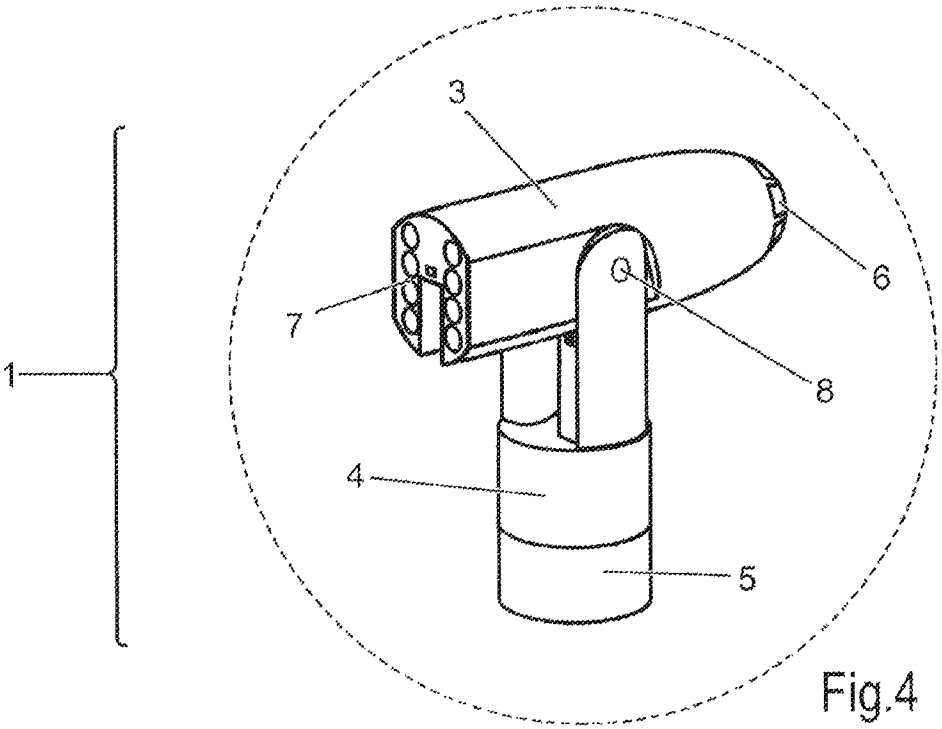
FIG. 4 is a diagrammatic view of one example of launch tubes and a mount for the countermeasures of the invention.
Figure 5:
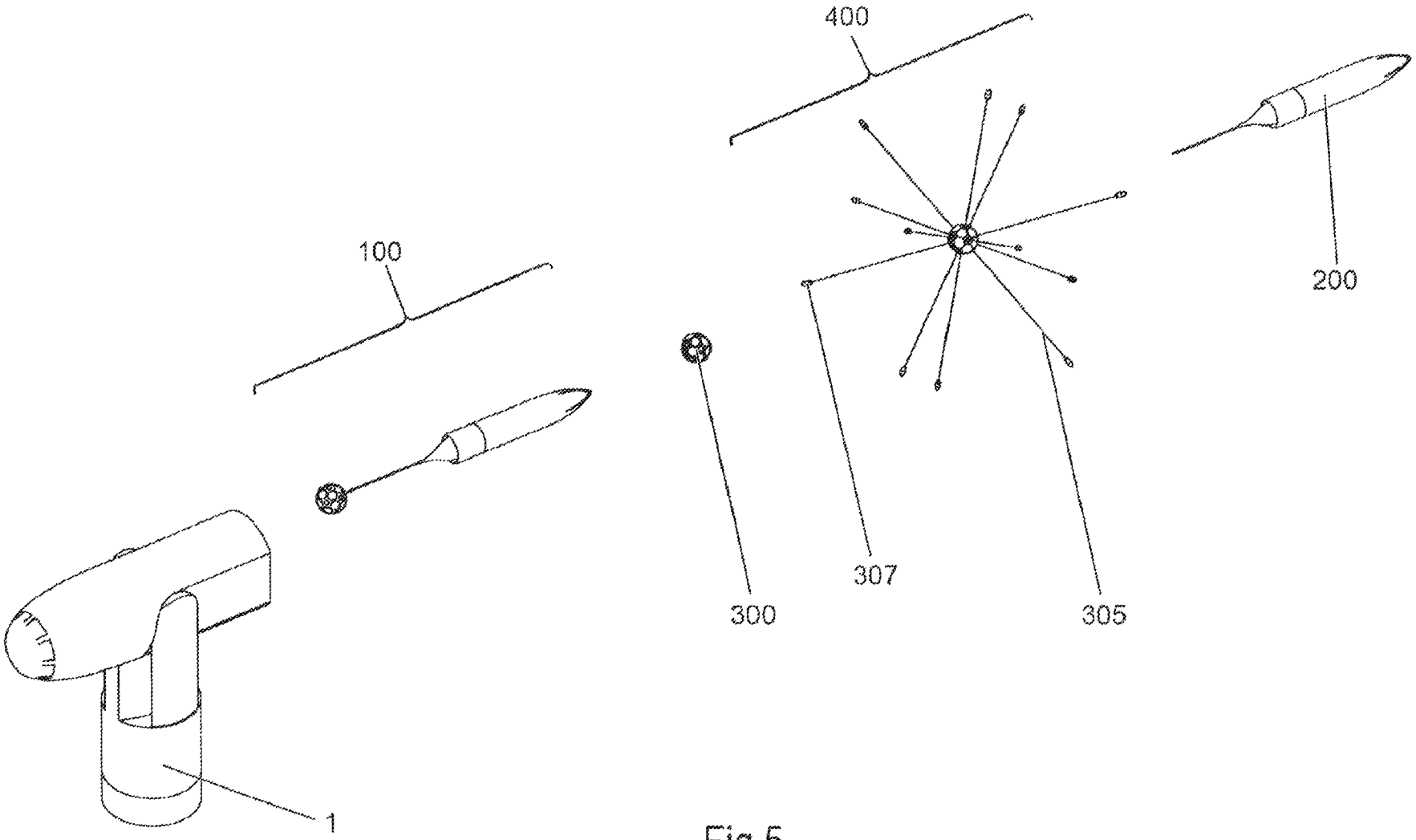
FIG. 5 is a sequential diagrammatic view of deployment of countermeasures of the invention.

FIG. 3 depicts a side view of the launch system 1 mounted on the bow and stern of a submarine 20 in their erected and ready position. An additional embodiment of this launch system 1 design for mounting could use an internal launch system that could deploy outside of the submarine 20 when the system in needed, thus maintaining a streamlined shape of the submarine when launch system 1 is not deployed. A preferred embodiment for the mounting of the launch system 1 would be to mount it in multiple locations that allowed for 360-degree coverage of the submarine. In some embodiments, the launch system may be stowed in internal compartments that are opened to deploy the launch system. FIG. 4 shows the launch system 1 including a base 5 with a tube pod base 4 mounted on its top. The launch tube pod 3 is mounted to the tube pod base 4, which houses the launch tubes 7, in turn housing counter-torpedo systems 100 (not shown in this figure). Launch pod 3 is articulated in pitch via the pivot point 8. When permanently mounted to the exterior of a submarine, tube pod nose cone 6 is used to reduce drag when the pods are in the stowed position (cone forward). FIG. 5 depicts an operational sequence of counter-torpedo system 100. The drawing shows launching of counter-torpedo system 100 from launch system 1 where an orb 300 is towed to a best countermeasures deployment position, as calculated prior to launch, by a tow motor propulsion device 200. Orb 300 is released at a predetermined deployment location, and propulsion tow device 200 continues until its fuel is expended. Once deployed, orb 300 in turn is provided with one of several possible mechanisms for releasing its own propulsion devices 307 in order to extend lines 305 from the orbs into their fully extended respective deployment positions 400. At least one sensor 306 (FIG. 12) may be integrated in or on each line 305. In some embodiments, it is anticipated that the sensors would be encased in expanded portions of the line, such as where the lines are of a plastic material, or in bubbles of plastic integrated with the lines so that the lines may be pulled into an extended position without tangling. In other embodiments, at least some of the lines may be of or contain a metallic or other conductive portion so as to serve as antennas for emitting electrical or electromagnetic jamming signals. Here, a voltage potential of perhaps 1,000-10,000 volts or more from a high voltage source in an orb may be applied between two or more of the lines to develop an electrical field in the water in an attempt to disrupt or destroy sensors and/or circuitry of a wire guided or other torpedo moving near or between the lines. Current limiting of the high voltage source would be necessary due to the salt content of the ocean. In this instance, induced currents in the wires might also cause sudden movement of the torpedo that might break the communications wires or otherwise disrupt operation of the torpedo. In other similar embodiments, a temporary high electrical current between the lines may create a sufficiently large magnetic field to trigger a proximity sensor of a torpedo, causing it to detonate. It is anticipated that these embodiments would need to be deployed as far as possible, perhaps up to 1,000 yards or so, from a submarine to be protected so as to have as much an opportunity to evade a torpedo or deploy other countermeasure solutions.

Figure 6:
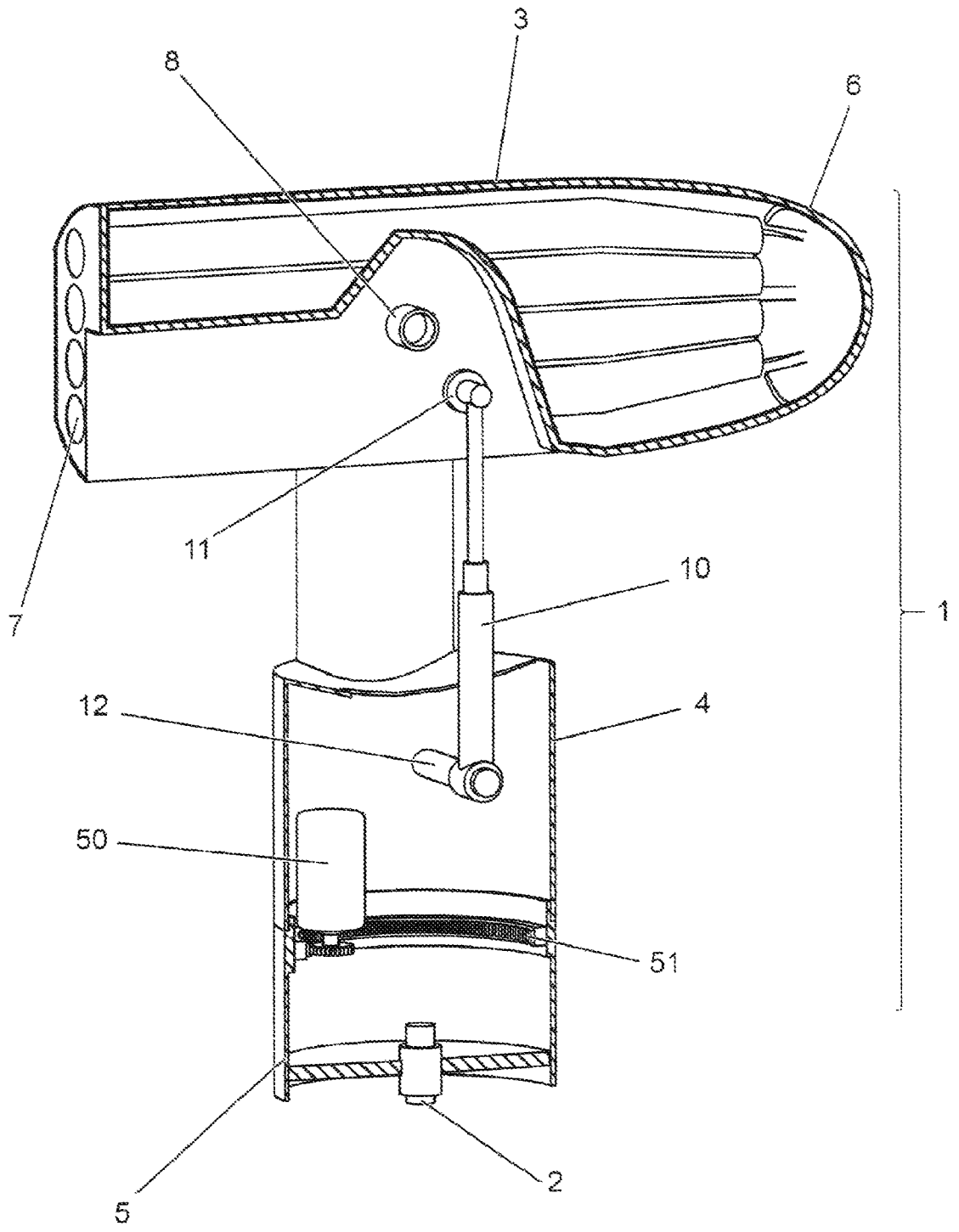
FIG. 6 is a broken away view showing arrangement of launch tubes and construction details of the invention.

FIG. 6 depicts the launch system 1 as comprising multiple launch tubes 7, which house the counter-torpedo system (not shown in drawing) that are housed in a launch tube pod 3. The aft section of the launch tube pod 3 has a tube pod nose cone 6 attached to it to assist in forward flow of water around the pod when it is in its stowed position (cone forward). The launch tube pod 3 is mounted to the tube pod base 4, which pivots at its pivot point 2 on the base 5. The launch tube pod 3 articulates in pitch being mounted to the pod pivot point 8 via a servo 10 mounted to the launch tube pod 3 via a pod servo mount 11 and the pod base mount 12. The pod can be rotated on a rotational axis on the base 5 via a gear ring 51 and an electric motor 50 mounted on the inside of the tube pod base 4 when commanded to do so by the crew of the submarine or by an existing automatic countermeasures system on the submarine when a threat is detected. Rotation, as well as elevation of the launch system 1 can be controlled by the crew or by the internal submarine's countermeasures system.

Figure 6A:
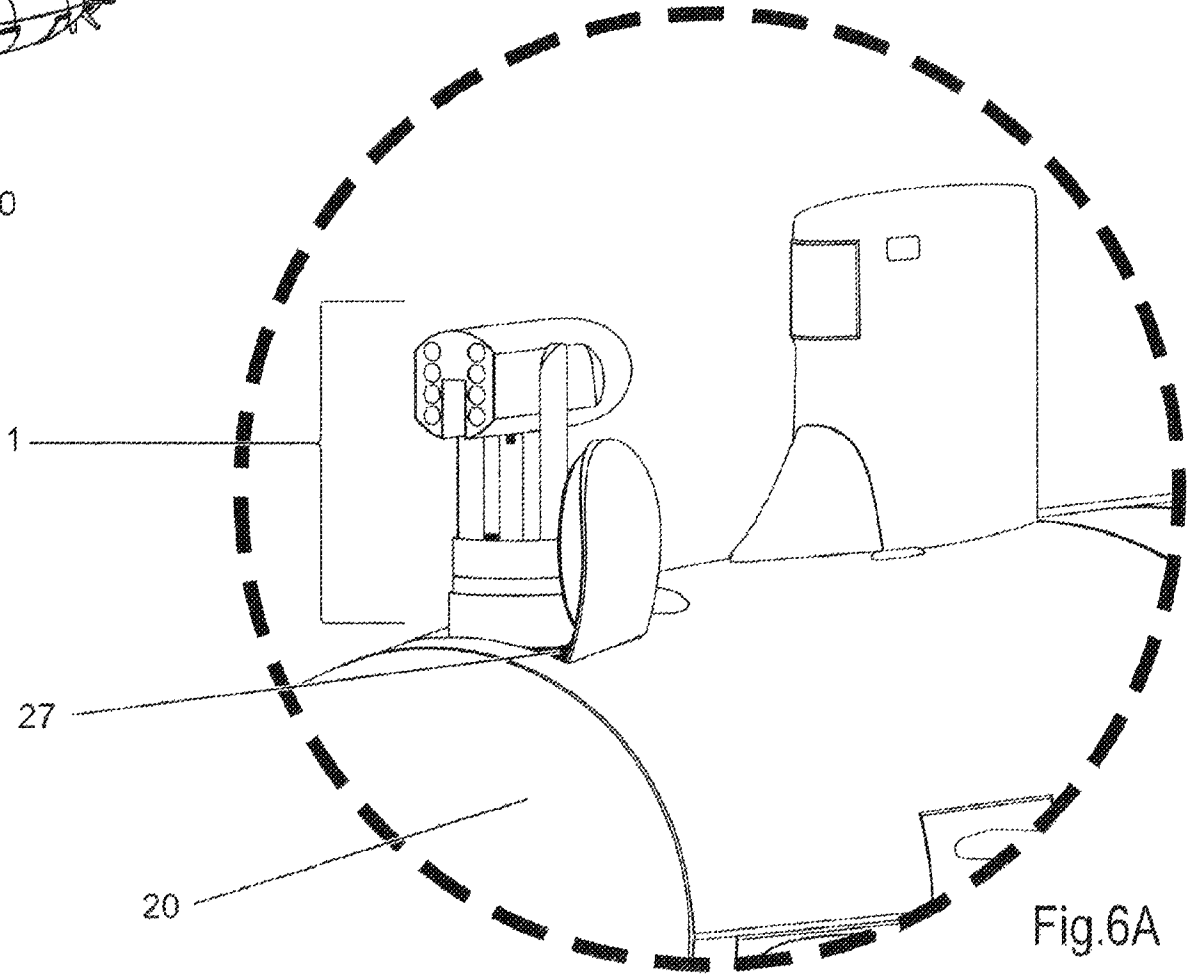
FIG. 6A is an enlarged partial view of a mount and launch tubes deployed from a submarine.
Figure 6B:
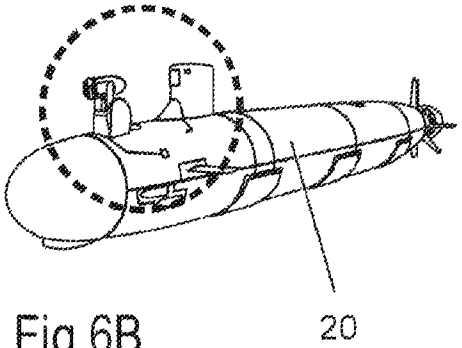
FIG. 6B is a view showing origination of FIG. 6A.

FIG. 6A depicts a closer overall view of FIG. 6B, which shows a cut-out of the system mounted on the submarine 20 (not to scale). In this particular embodiment, the launch system 1 is shown in its extended position from a missile silo 27 mounted to the front of the submarine 20. This embodiment depicts an internal mounted system that can be extended and activated when needed. Other embodiments can have the launch system 1 mounted to the fuselage of a submarine 20 or ship 30 (not shown). Surface ships may embody a version that is internally mounted and extended when needed, similar to the particular embodiment shown in FIGS. 6A and 6B or have permanently mounted countermeasures launch tube stations.

Figure 6C:
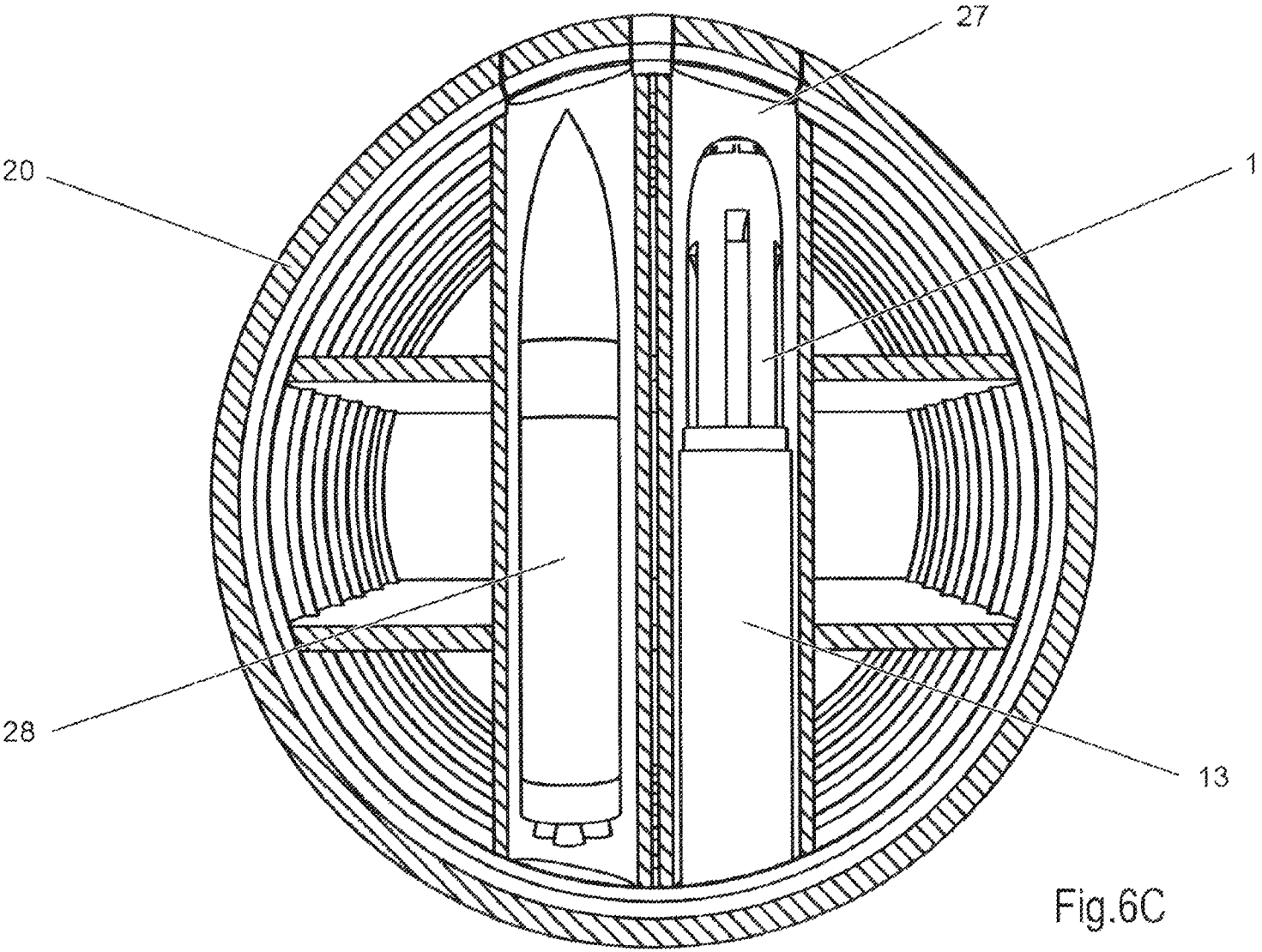
FIG. 6C shows a cut-away view of substitution of a countermeasures system in a missile silo of a submarine.

FIG. 6C depicts a lateral cross-sectional view of a typical submarine 20 fuselage showing missile silos 27 holding a vertically launched tactical missile 28 and the launch system 1. In this particular embodiment, the launch system 1 may be mounted in one of the missile silos in place of a missile and is lifted out of the hull and into a launching position via a telescoping hydraulic lift tube 13. This tube can be hydraulically actuated to lift the launch system 1 out of the missile launch silo 27 for preparation to engage any threats. In other embodiments, and as noted, one or more of countermeasures systems 100 may be integrated into a torpedo-like housing and fired from existing torpedo tubes of a submarine (not shown). In other embodiments, the system 10 itself may be launched from one or more torpedo tubes. As shown in FIG. 6C, a missile launch tube of the submarine may be loaded or configured to contain a deployable system 1 of the invention, and possibly launch a plurality of orbs to establish a field of orbs larger than what a single orb could cover. Here, a delivery vehicle would be configured similar to a torpedo to fit in a torpedo tube and have a hull that would break apart, open up or otherwise eject the orbs therein in a spread to uniformly cover an extended area. As a torpedo tube in a United States submarine is typically 21 inches in diameter, it is apparent that the orbs launched from a submarine torpedo tube or from a torpedo-like delivery vehicle would need to be somewhat smaller, perhaps on the order of 16 inches to 20 inches or so in diameter. In addition, and as noted, while an orb is disclosed, a stubby cylindrical body is also contemplated, with at least one line deployed from the front and back, and other lines deployed circumferentially from around the body to define a generally spherical volume into which the lines are deployed. The bodies may take other shapes, such as streamlined configurations in order to travel further from an asset to be protected. When used in the atmosphere, the bodies may be streamlined, and where deemed necessary, may be provided with fins for directional stability. A steering system may be provided for the fins for steering the body in front of an oncoming threat, the steering system either being in an aircraft or on board the body itself. Such steering systems for steering or pointing toward a target are well known, such as those that employ infrared quadrant detectors for determining location of a heat source, such as an oncoming missile exhaust. Likewise, an airborne countermeasures body may be steered in front of an oncoming missile by radar control from an aircraft that launched the body. From the foregoing, it should also be apparent that a countermeasures body of the instant invention may be launched from the ground in front of a threat.

Figure 6E:
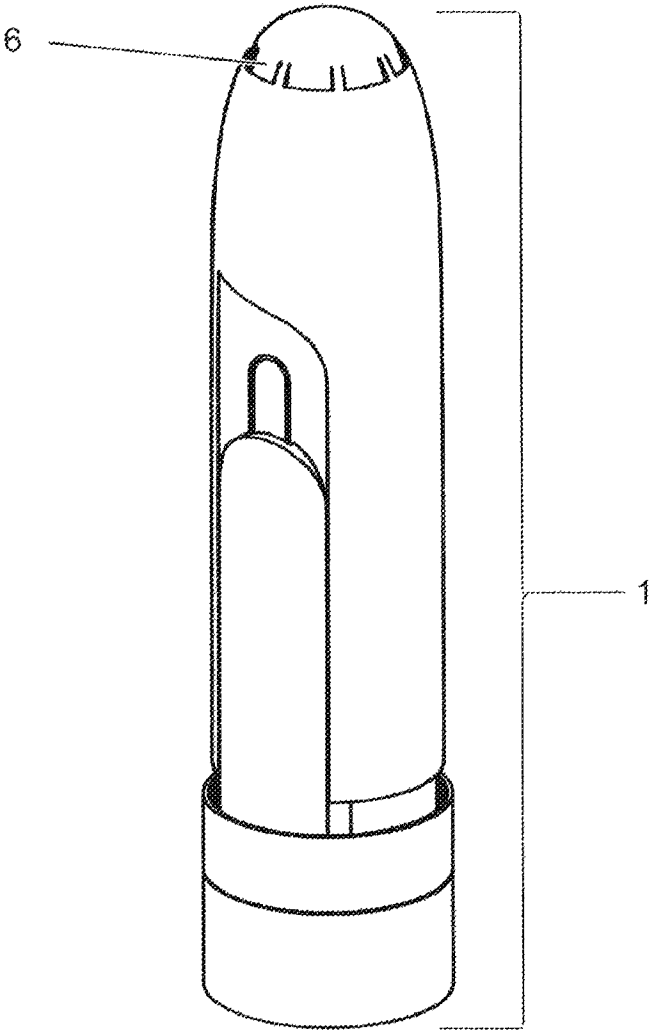
FIGS. 6D and 6E show a sequence of launch tube mount operation prior to launch of countermeasures of the invention.
Figure 6D:
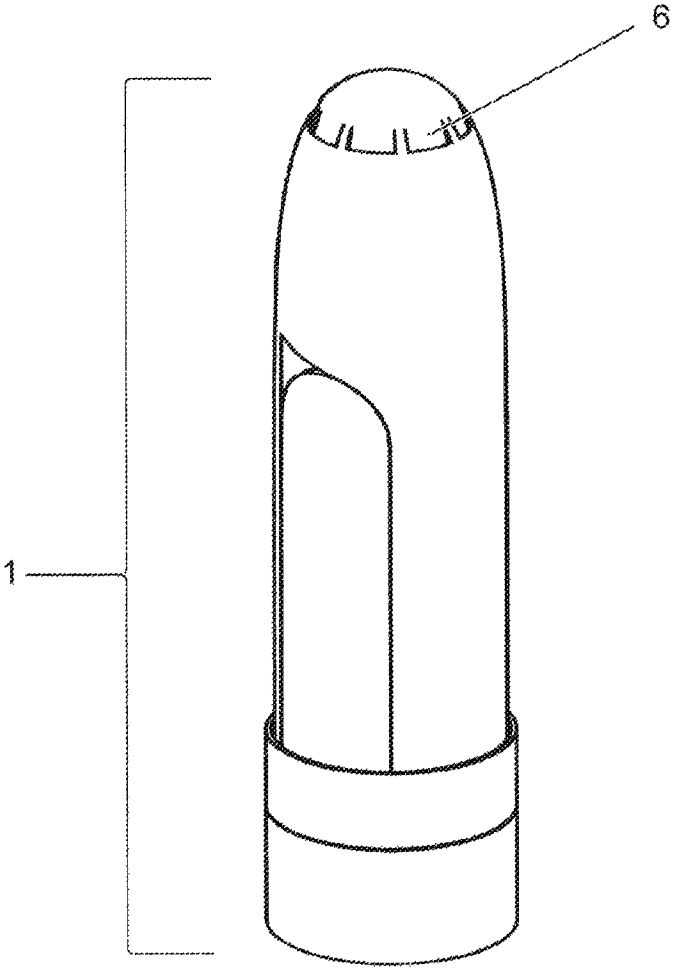

FIG. 6D is a perspective view that depicts an embodiment of the launch system 1 in its stowed position with the tube pod nose cone 6 in the upper most position.

FIG. 6E is a perspective view (for this particular embodiment) showing the launch system 1 still in its stowed position with the tube nose cone 6 in the upper most position but being lifted out of its stowed/locked position hydraulically (not shown) in preparation for use.

Figure 6G:
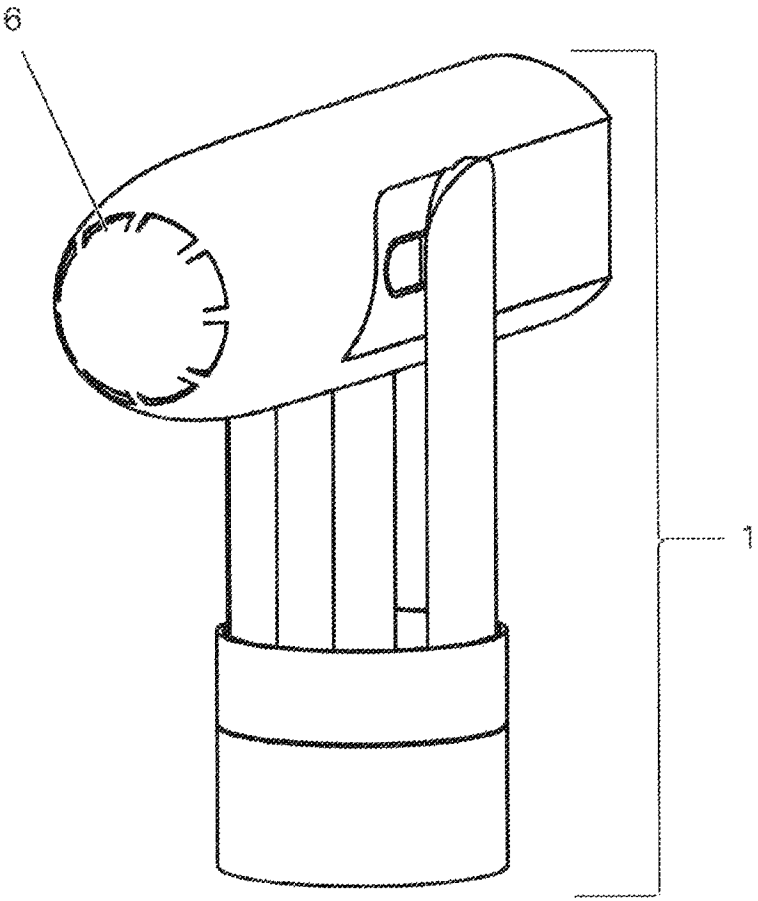
FIGS. 6F and 6G show opposite ends of a mount and launch tube of the invention.
Figure 6F:
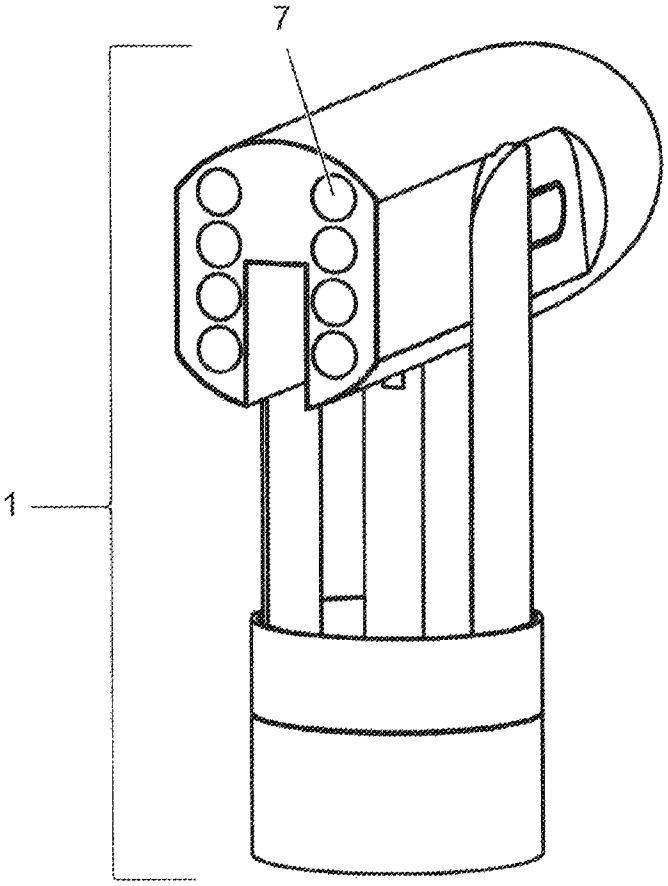

FIG. 6F depicts a front perspective view of the launch system 1 in its ready-to-launch position, with launch tubes 7 towards incoming threat.

FIG. 6G depicts a rear perspective view of the launch system 1 and the tube pod nose cone 6 (which is now in the aft most position) in the ready-to-launch position.

Figure 7:
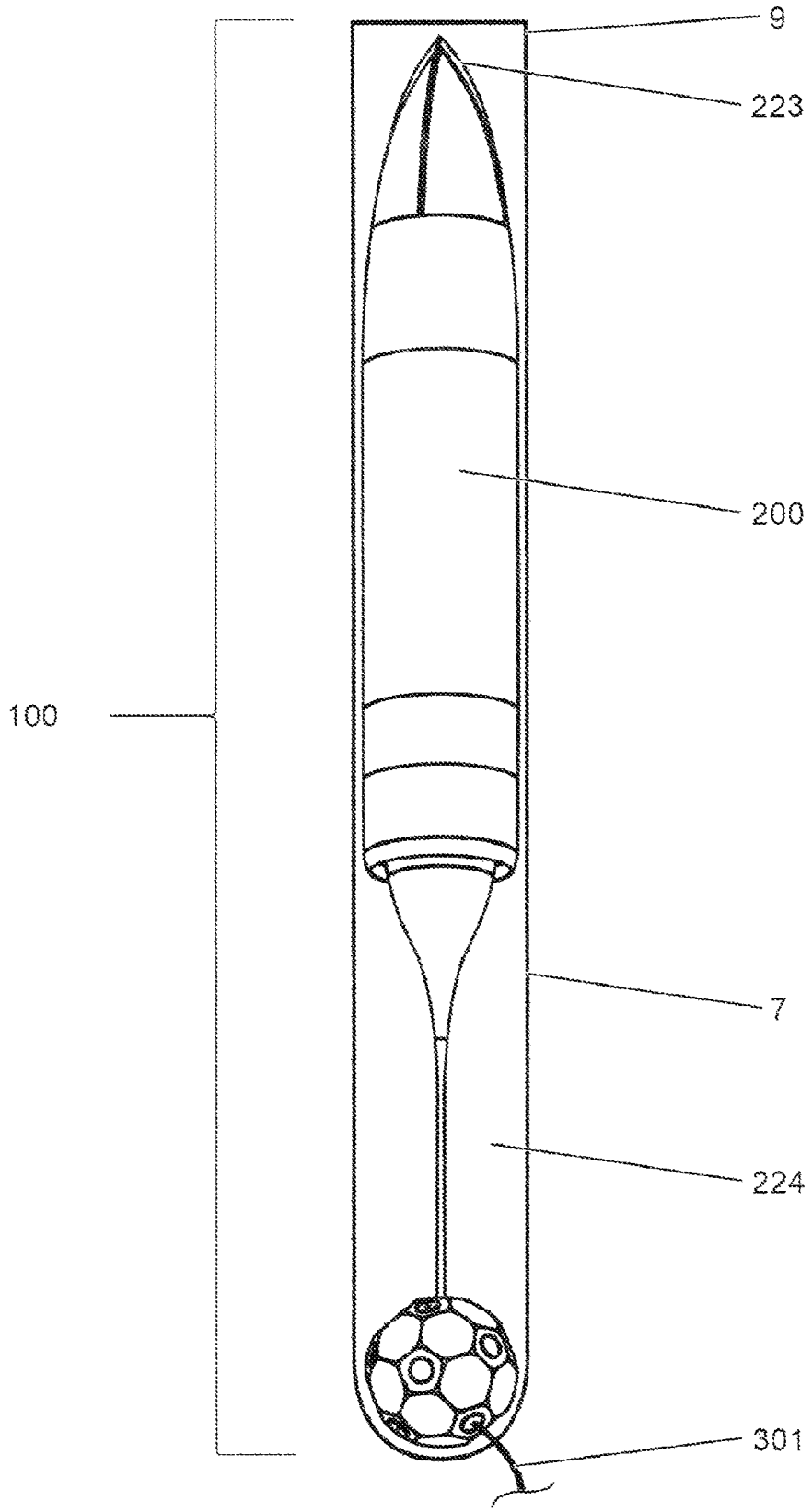
FIG. 7 is a diagrammatic view of a countermeasures system of the invention within a cut-away launch tube.

FIG. 7 depicts a single launch tube 7 with a launch tube cover 9, the launch tube containing a single propulsion device 200, in this embodiment a rocket configured for underwater operation. Launch tube 7 is removably housed inside of the launch tube pod 3 (not shown). Launch tube 7 and possibly hollow interior portions of rocket 200 and orb 300 (FIG. 8) may be filled with a non-compressible dielectric fluid or semi-fluid material 224 (such as a gel) so that pressures at the submarine's operational depths do not adversely affect the rockets and orbs. Components inside the rockets and orbs that have voids in them would be sealed, potted or otherwise protected from harmful pressures in accordance with conventional underwater construction and sealing techniques. Likewise, airborne and space-based embodiments would be constructed for use in their respective environments.

When the counter-torpedo system 100 is activated, as by signals via a counter-torpedo system umbilical cord 301 (FIGS. 7 and 12), the solid rocket motor assembly 219*a* (FIG. 9) is activated and the counter-torpedo system 100 leaves the launch tube 7. By way of example, launch tube cover cutting blades 223 may be employed to assist in cutting through launch tube cover 9. In such embodiments, the launch tubes may be hardened and sealed so that pressure from the rocket motors would develop therein and assist in splitting open the covers after being split or scored by blades 223. In other embodiments, the pressure alone in a sealed launch tube may be sufficient to blow the cover off a launch tube and eject a tow motor.

Figure 8:
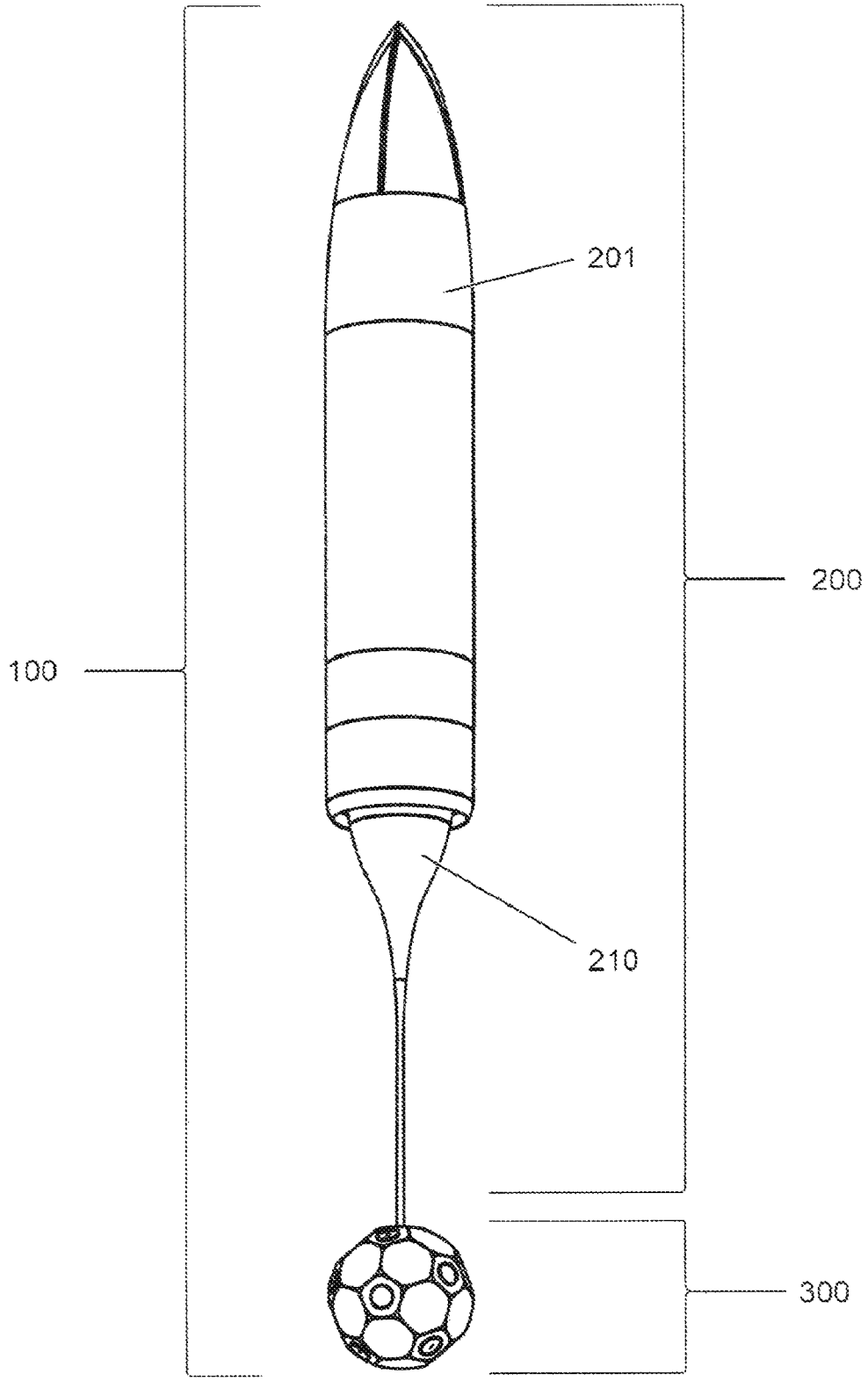
FIG. 8 is a diagrammatic view of an exterior of a countermeasures system of the invention.
Figure 9:
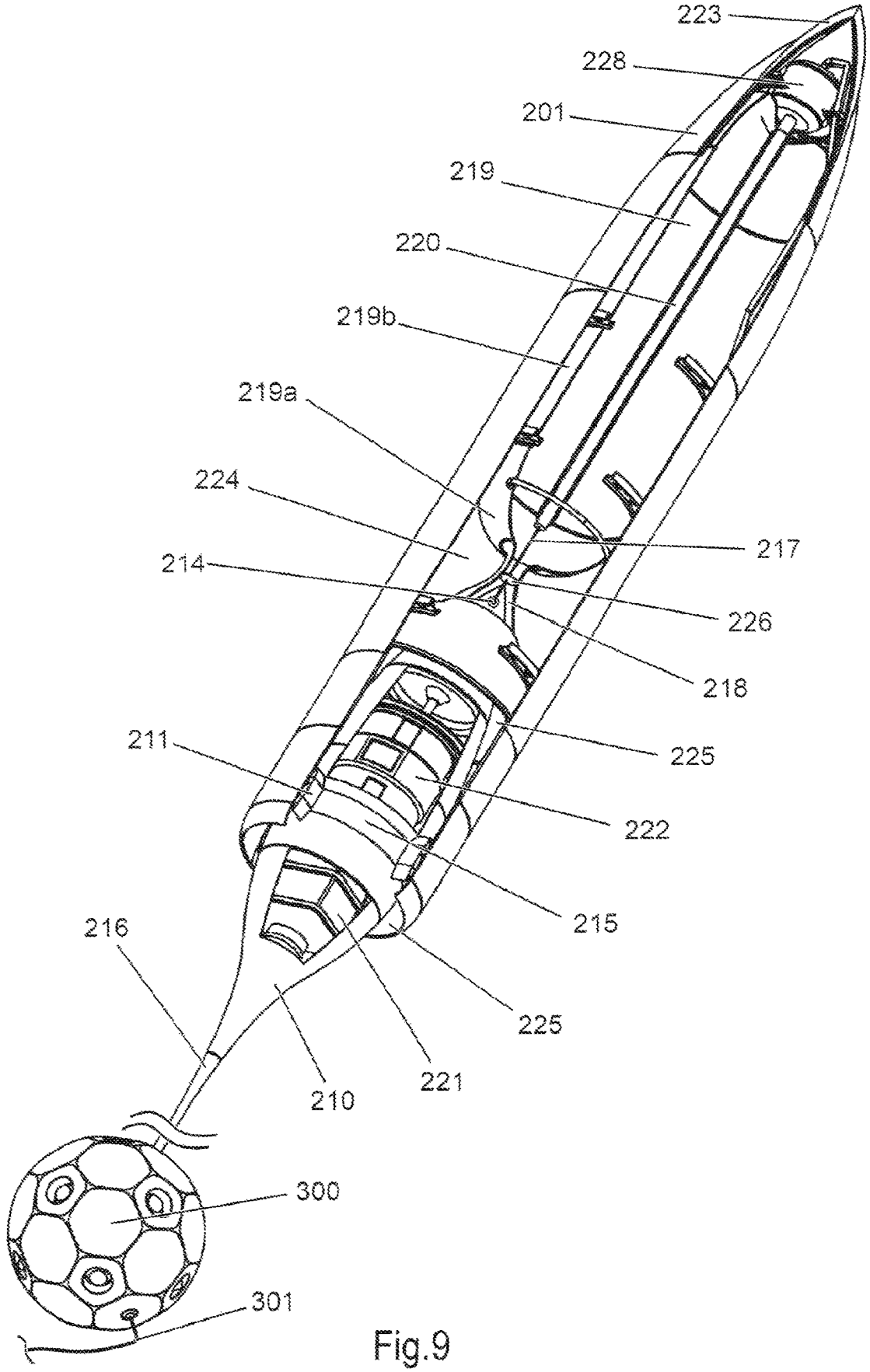
FIG. 9 is a cut-away view showing an interior of an orb tow rocket of the invention.

FIG. 8 depicts counter-torpedo system 100 that is made up of orb delivery vehicle 200 and orb 300. The orb delivery vehicle is made up of propulsion system body 201, exhaust spike 210 and solid rocket propulsion motor assembly 219*a* (FIG. 9). As noted, for aerial embodiments, the rocket propulsion motor may be provided with fins and a guidance system, or in other embodiments the rocket motor may be omitted and the countermeasures orb merely launched in front of a threat when the threat is very close to an aircraft to be protected, such as about 100 yards to 500 yards or so. In any case, timing and distance from a missile threat for line deployment should be sufficient to allow the smaller line tow rockets to tow their respective lines away from the orb body, as will be explained, in less than 1 or 2 seconds before a threat missile enters the volume defined by the lines. In other words, the orb and line tow rockets should be configured so that the threat missile enters the protected sphere just as the line tow rockets have towed the lines to their maximum extent and thereafter disable or destroy the threat missile. In this embodiment, being airborne, the orb may be smaller and have a smaller spherical volume in which to destroy a rocket threat, such as perhaps up to 20 feet or so in diameter.

FIG. 9 depicts internal parts of counter-torpedo system 100 (FIG. 5), which is made up two other main sections, orb delivery system 200 (FIG. 8) and orb assembly 300. Exhaust spike 210 is generally rigid and mounted to propulsion system body 201 by exhaust direction vane assembly 215 via hydrodynamic foils 211. Orb assembly 300 is connected to orb delivery system 200 via exhaust spike 210 and receives its electrical signals through fire control system umbilical cord 216, which may be routed through exhaust spike 210. In one embodiment, fire control umbilical cord 216 relays commands to the guidance control unit/targeting unit 228. In another embodiment, fire control umbilical cord 216 transfers fire command straight through to the ignition cord 217 in order to ignite the rocket. Orb 300 receives its electrical commands/signals through counter-torpedo system umbilical cord 301 (from the crew manually or from the submarines counter-threat system automatically). Orb delivery system 200 (FIG. 8) may receive electrical power from an orb power storage system within orb 300, with other embodiments receiving power from the power storage system 221 within the rocket. In some embodiments, orb delivery system 200 (FIG. 8) may be controlled by commands from an orb control system within the orb, with an optional embodiment for control provided by the fire control system/timer 222 via fire control system umbilical cord 216 and counter-torpedo umbilical cord 301. This embodiment would be for a version that used an optional embodiment guidance control unit/targeting unit 228. A command can then activate ignition cord 217, which exits exhaust spike 210 from ignition cord exit port 214. Once solid propellant 219 (of solid-rocket motor assembly 219*a*) is ignited within solid rocket fuel tank 219*b*, combustion gasses flow down combustion channel 220, burning through exhaust nozzle seal 226 and exit out of exhaust nozzle 218 through exhaust chamber 225 and over hydrodynamic foil 211, causing system 100 (FIG. 5) to depart a launch tube 7 (FIG. 7). In some embodiments, hydrodynamic foils 211 can assist with keeping counter-torpedo system 100 (see FIG. 5) from rotating upon its linear axis as it exits launch tube 7 so that the orb is deployed with minimal disturbance. In other embodiments, at least the rocket may be made to spin, as by the foils 211 being angled, or ridges, foils or fins may be constructed on the rocket motor portion to cause it to spin, in order to accurately direct the rocket in the direction it is launched. In other embodiments, a guidance and stability system may be incorporated in order to direct the orb to a precise location. Such guidance and stability systems may be similar to those found in currently existing drone helicopters, and which are small, have low current and voltage requirements and are inexpensive. Here, a tow rocket could use thrust vectoring or fins controlled by a guidance and stability system to achieve both a predetermined location and depth for a towed orb.

As noted, an interior of counter-torpedo system 100 (see FIG. 5) would be filled with a non-compressible dielectric fluid or gel 224 for pressure equalization, and possibly for cooling, within propulsion system body 201. In some embodiments, launch tube cover cutting blade(s) 223 mounted at a top of the propulsion body 201, are used to assist with cutting through launch tube cover 9 (FIG. 7) when the system is activated to launch. In other embodiments, cover 9 (FIG. 7) may be fitted to the tube with a friction fit and dislodged when the rocket is ignited.

Figure 9A:
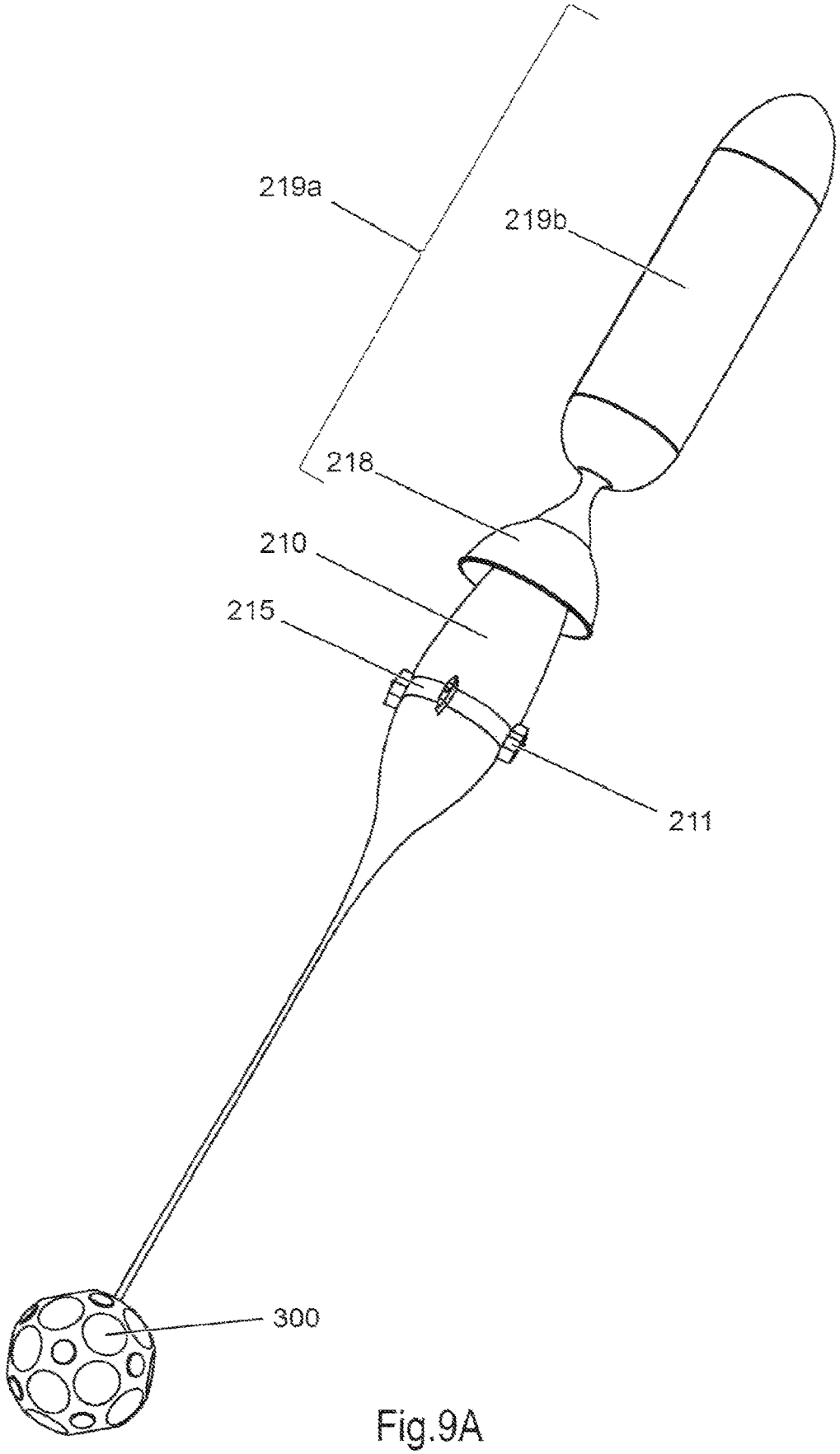
FIG. 9A is a view showing construction details of an orb tow rocket of the invention.

FIG. 9A depicts a perspective view of internal assemblies of the counter-torpedo system 100 (external body not shown) which consists of solid-rocket motor assembly 219*a* and solid-propellant tank 219*b*, which is mounted above exhaust spike 210. Spike 210 is configured to house at least electrical components of the system and protect them from heat of the combustion gasses. Exhaust nozzle 218 is shown mounted to a bottom of solid-propellant tank 219*a* and directs exhaust gasses around exhaust spike 210 and foils 211 and between the exhaust spike and interior walls of propulsion body 201. Exhaust spike 210 is connected to interior walls of propulsion system body 201 (not shown) by hydrodynamic foils 211 mounted to the exhaust direction vane assembly 215. Orb delivery system 300 is attached at the aft portion of the exhaust spike 210.

Figure 10:
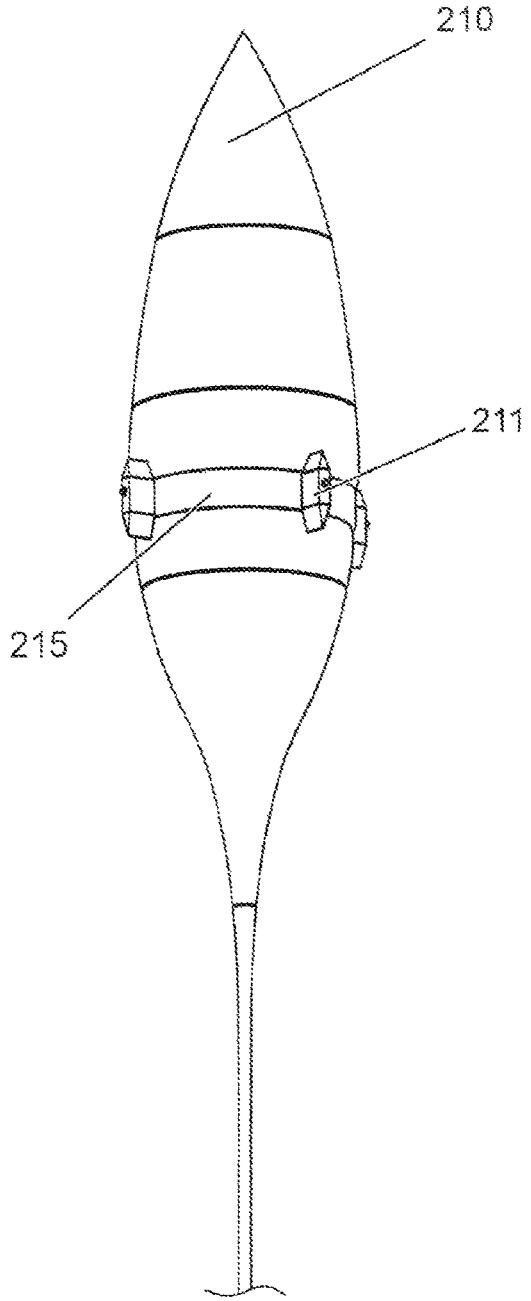
FIGS. 10 and 10A is a view showing construction details of rocket exhaust foils of the invention.
Figure 10A:
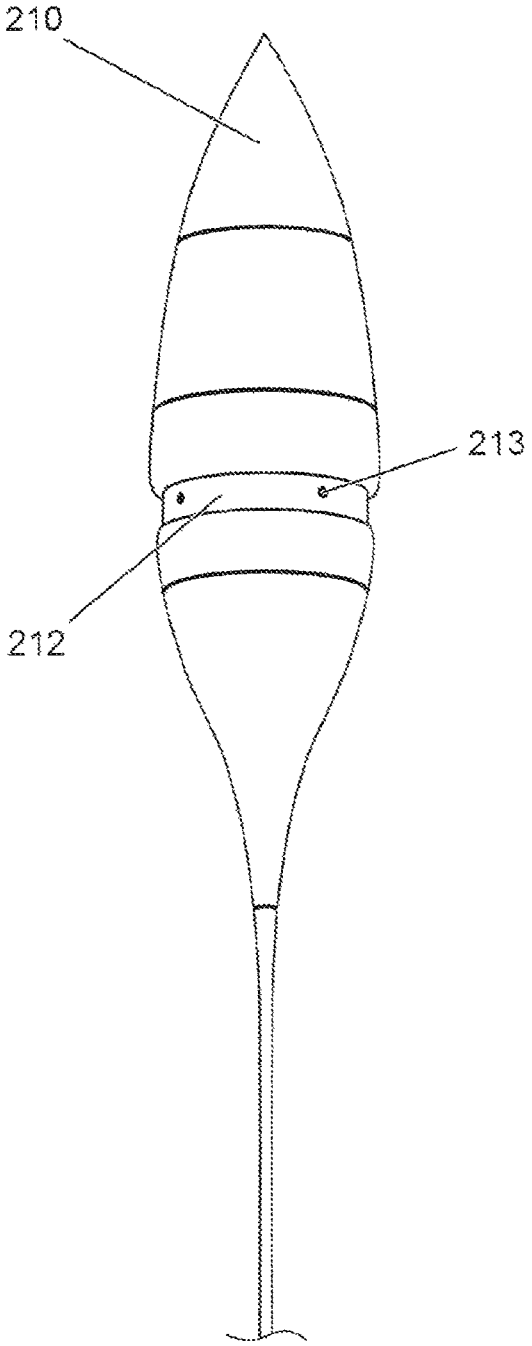
Figure 11:
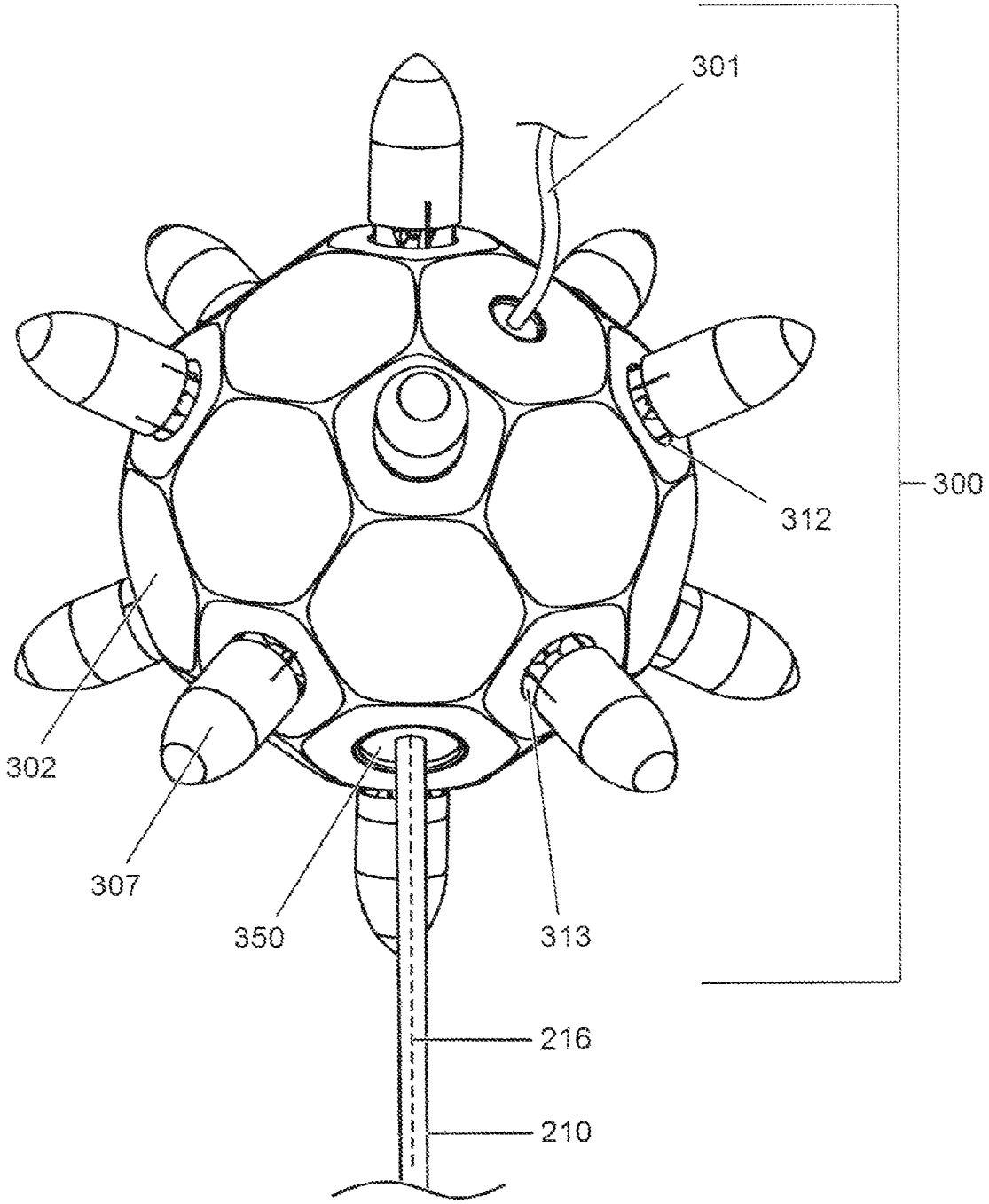
FIG. 11 is a diagrammatic view of an orb of the invention showing line deployment rockets in a partially deployed position.

FIG. 10 and FIG. 10A depict a side perspective view of exhaust spike 210, showing exhaust direction vane assembly 215 and exhaust direction vane mounting recess point 212 as well as hydrodynamic foil mounting point 213 and hydrodynamic foil 211. As should be apparent, the vane assembly and mounting points 213 may be made to be controllably movable so that foils 211 are angularly moved to angularly direct exhaust gasses in order to controllably steer system 100 (FIG. 5) in a desired direction. FIG. 11 depicts orb assembly 300 made up of orb body assembly 302, which houses an entrance point of counter-torpedo system umbilical cord 301. Several mechanisms may be used for extending lines from an orb. Typically, there would be a plurality, such as twelve or so lines, each deployed by the deployment mechanism. In one embodiment, micro propulsion devices 307 (shown partially deployed), which also may be solid rocket motors to deploy the lines, are mounted in the orb and which are aimed in every direction away from orb body 302 so as to generally define a spherical volume in the water, with orb body 302 at a center thereof. It is noted that launch tubes for microrockets 307 and entrance points for cords 301 and 210 are sealed against ingress of water. In addition, and also as noted, an interior of orb 300 is filled with a non-compressible dielectric substance, such as a silicone gel, that may also be waterproof and water repellant so as to prevent ingress of water and electrically isolate components in the orb.

Figure 13A:
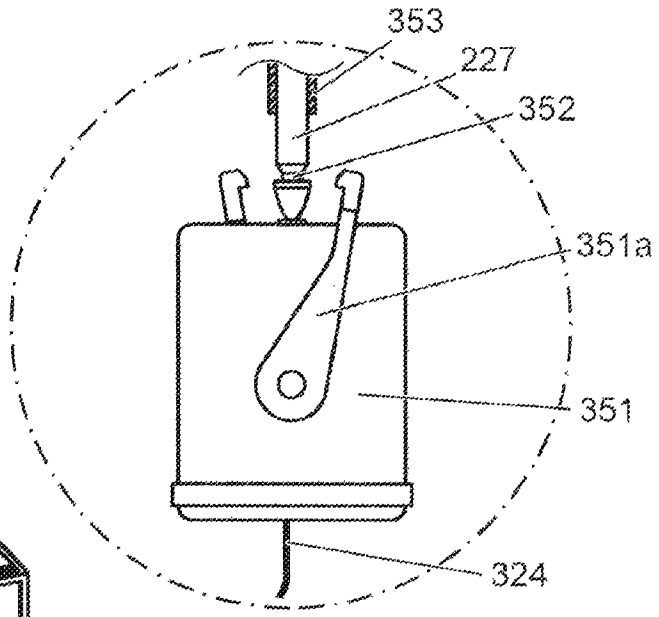
FIG. 13A is a diagrammatic exterior view of a release mechanism for an orb from an orb tow rocket.

Each of micro solid rocket motor launch tubes 313 are further sealed in the tube by a seal 312. Orb assembly 300 is connected to exhaust spike 210 through orb assembly mounting point 350 and into an exhaust spike lock/release mechanism 351 (FIG. 13A). Exhaust spike 210 also houses fire control system umbilical cord 216 which acts as an ignition line for the solid rocket propellant 219 (not shown).

Figure 11A:
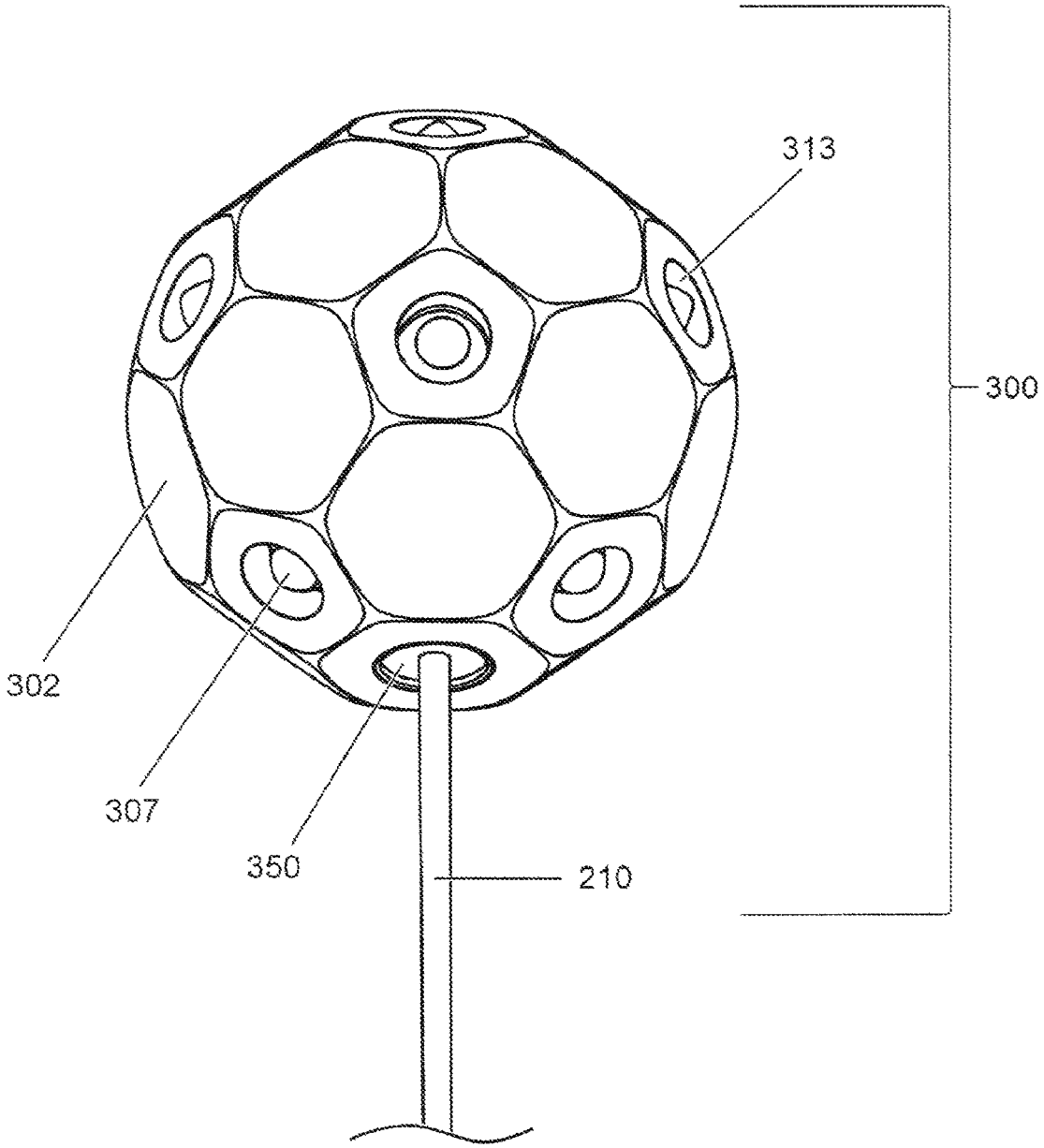
FIG. 11*a* is a diagrammatic view of an orb as it appears while being towed to a deployment position.
Figure 11B:
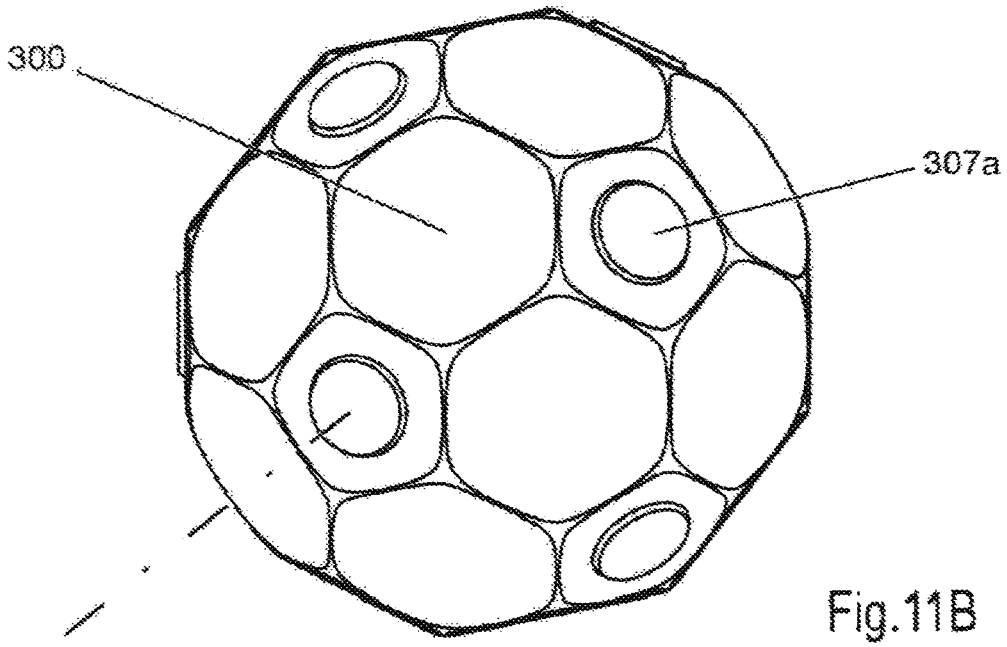
FIGS. 11B and 11C show another embodiment of an orb featuring covers over launch tubes that are pierced by line deployment rockets when deployed.

FIG. 11A is another perspective view of orb assembly 300 depicting micro solid-rocket motors 307 in their pre-launch configuration within micro solid-rocket motor launch tubes 313 mounted within orb body assembly 302. Orb assembly 300 is mounted to exhaust spike 210 at orb assembly mounting point 350. In some embodiments, microrockets 307 themselves are sealed within the tubes, while FIG. 11B shows the micro solid-rocket motor launch tubes covered by covers 307A.

Figure 11C:
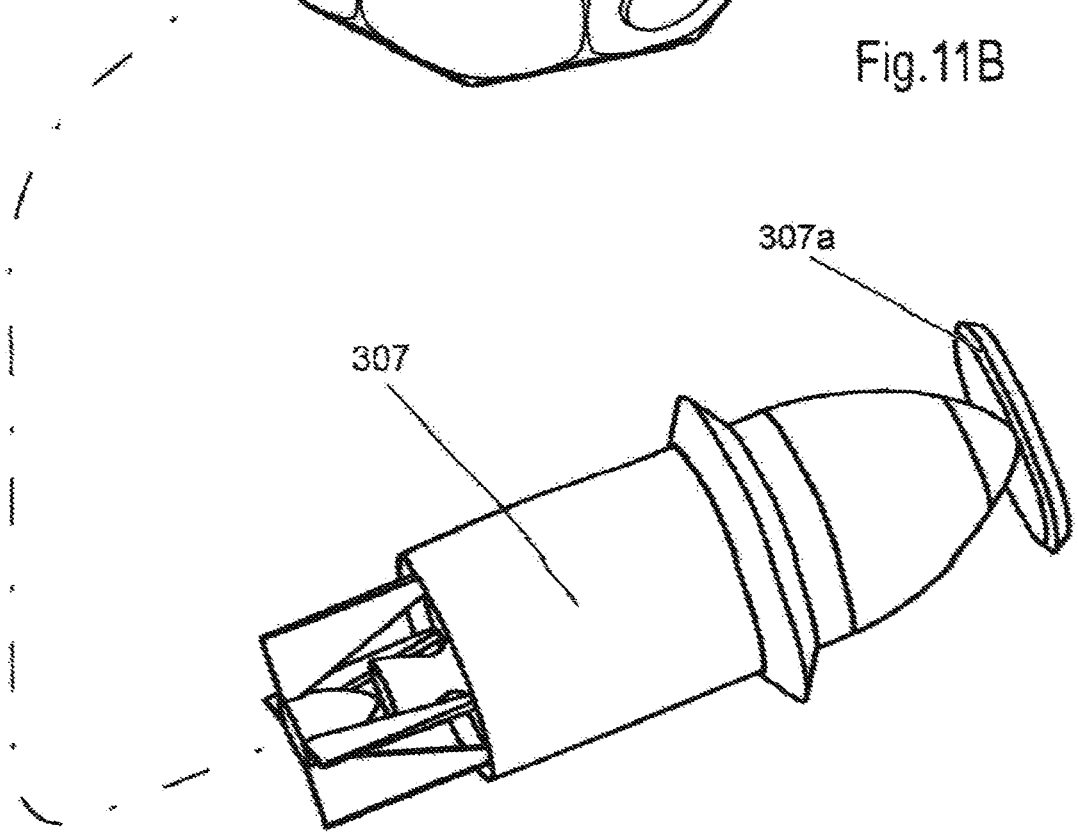

FIG. 11C depicts a perspective view of an embodiment of a micro solid-rocket motor 307 as it would sit below cover 307A. When ignited, the micro-rocket would cut through cover 307A, or the cover would be pushed or blown off and away from the launch tube. As noted above, cavities around motors 307 and interior voids of orbs 300 would be filled with the noncompressible dielectric gel or liquid in order to equalize pressure without damage to interior components. As also should be apparent, prop driven tow motors may be used instead of rockets in underwater applications. Other deployment mechanisms may be used in water and other mediums, as will be further explained.

Figure 11D:
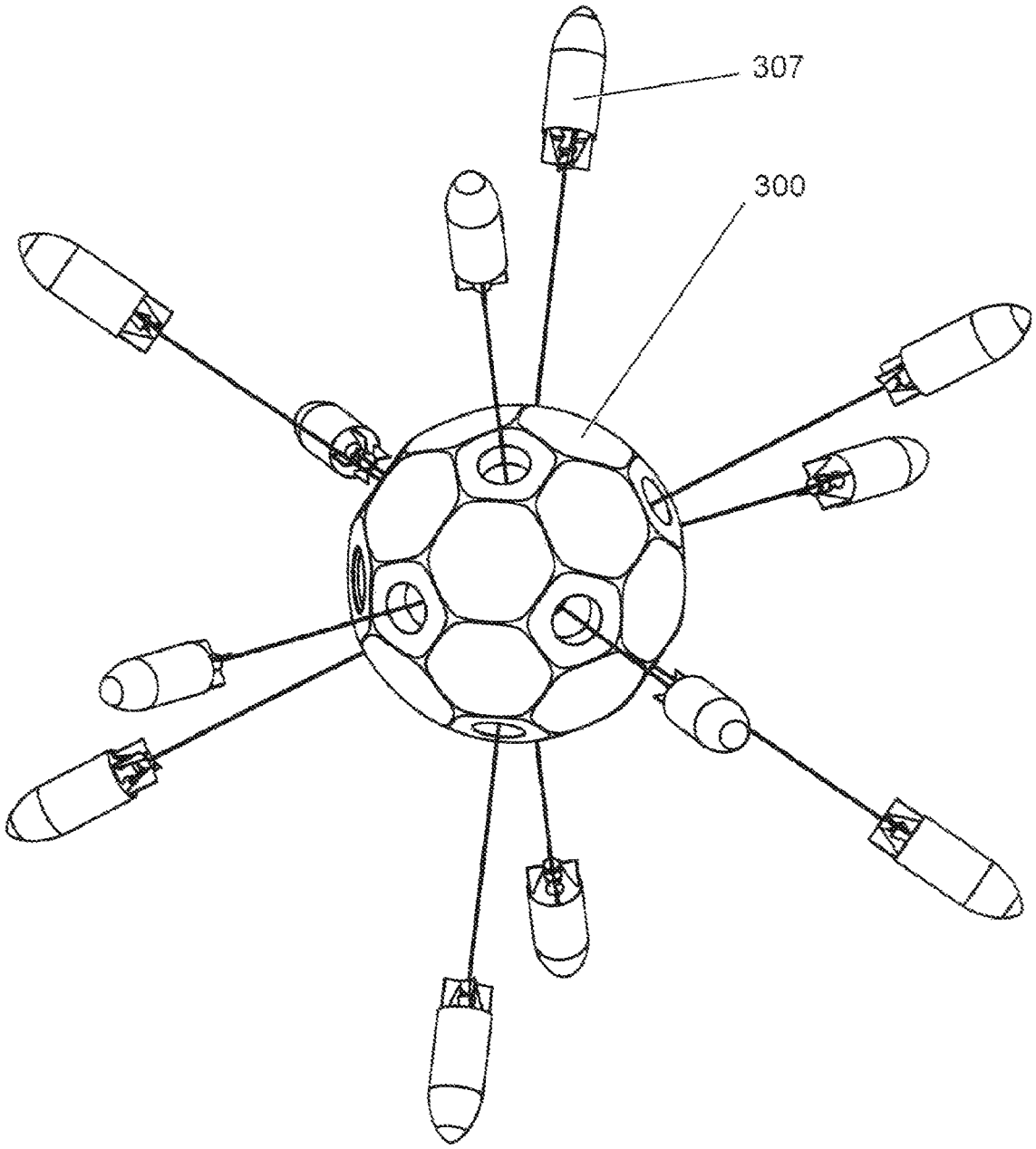
FIG. 11D is a diagrammatic view of an orb and line deployment rockets deploying line from an orb.

FIG. 11D depicts the released orb assembly 300 with micro solid-rocket motors 307 towing and extending lines during the deployment process.

Figure 12:
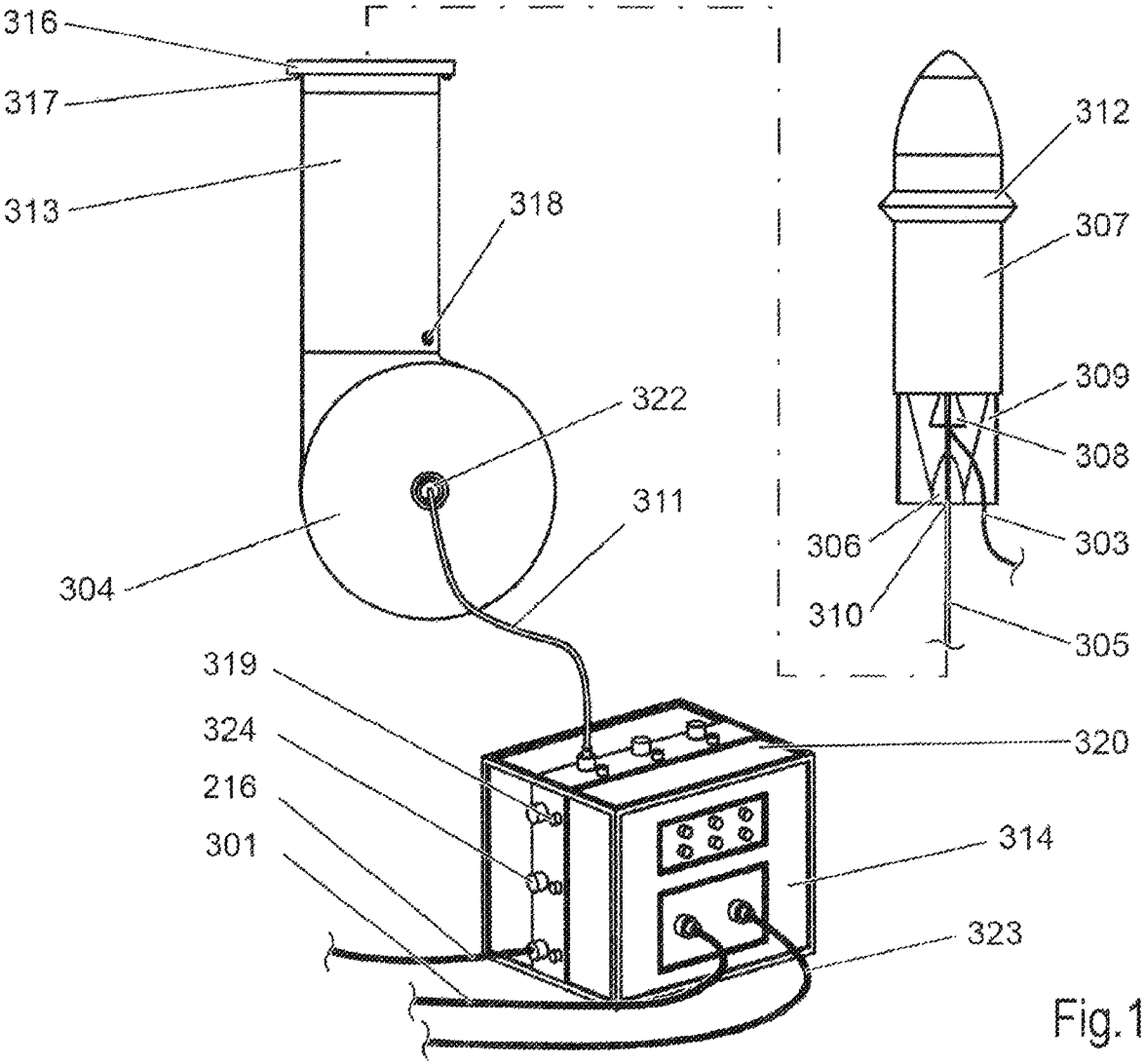
FIG. 12 is a diagrammatic view showing connections of a line tow rocket to a launch tube and orb control system.

FIG. 12 depicts sensors 306 which are shown integrated in lines 305. As noted, sensors 306 may be deployed in bubbles or bulges in lines 305 so that the lines 305 may be easily extended without risk of tangling. Likewise, flexible antenna or other emitters of signals may also be incorporated in bulges of lines 305. Also, audio transducers, or "noise-makers", may be mounted in an orb 300 (FIG. 11D). In some embodiments, not all lines would be equipped with sensors. For instance, lines that are extending from a respective orb to define a spherical volume in the water may be equipped with sensors in order to locate a threat or other object within the spherical volume defined by the lines. As such, lines having sensors may be on the left, right, above, below, in front of and to the rear of an orb. Location and proximity of a threat may be determined by comparing arrival time of signals or sound emitted from the threat at each sensor. Other lines without sensors can be equipped with antennas or transducers from which high electrical potentials or currents may be emitted in order to disrupt wire guided torpedoes passing between or near lines by inducing large electrical currents in their wires. As noted, some or all the lines, and possibly the orb, may contain explosives that are detonated in close proximity to a passing torpedo. In some embodiments, a spherical volume encompassed by the lines may approximate a profile of a submarine from either the front, a rear or side thereof, with transducers on the lines that emit signals that approximate at least one of magnetic, electrical and acoustic signals, or perhaps all of the signals, in order to fool a torpedo to explode as it approaches the spherical volume. In another embodiment, as some torpedoes use active sonar for terminal homing to a target, a sonar countermeasures receiver in the orb may include a sonar receiver to receive sonar signals, modify the received signals in amplitude and frequency and retransmit them so as to indicate to a torpedo that contact with a submarine is imminent, and cause it to explode. Another tactic may be to sense the received sonar signals and retransmit them in larger amplitude, making the spherical volume appear larger than it is to draw an oncoming torpedo into the spherical volume. In this instance, one or more orbs may be launched and positioned to one side of a retreating submarine's course, which may be in an opposite direction. Explosives may be incorporated in the countermeasures spherical volume, either separate from the orbs or within the orb and/or lines to either destroy the oncoming torpedo either within the spherical volume or develop a shock wave of sufficient intensity to fool a contact sensor of the torpedo that contact with a vessel has occurred, thus causing the torpedo to explode. A sonar profile of the retreating submarine may also be protected by such a ruse. A plurality of such countermeasure orbs may also be used to present confusing sonar signals to an oncoming torpedo, with the countermeasures signals possibly synchronized to present a large sonar profile. In addition, such an embodiment may be used to defeat or jam sonar of an attacking vessel.

Figure 12A:
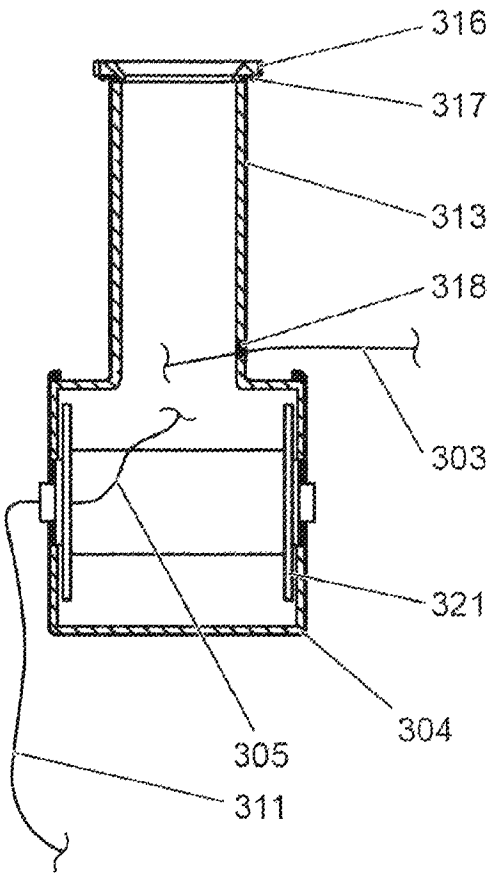
FIG. 12A is a cut-away view of a line reel and launch tube of a line tow rocket.
Figure 12B:
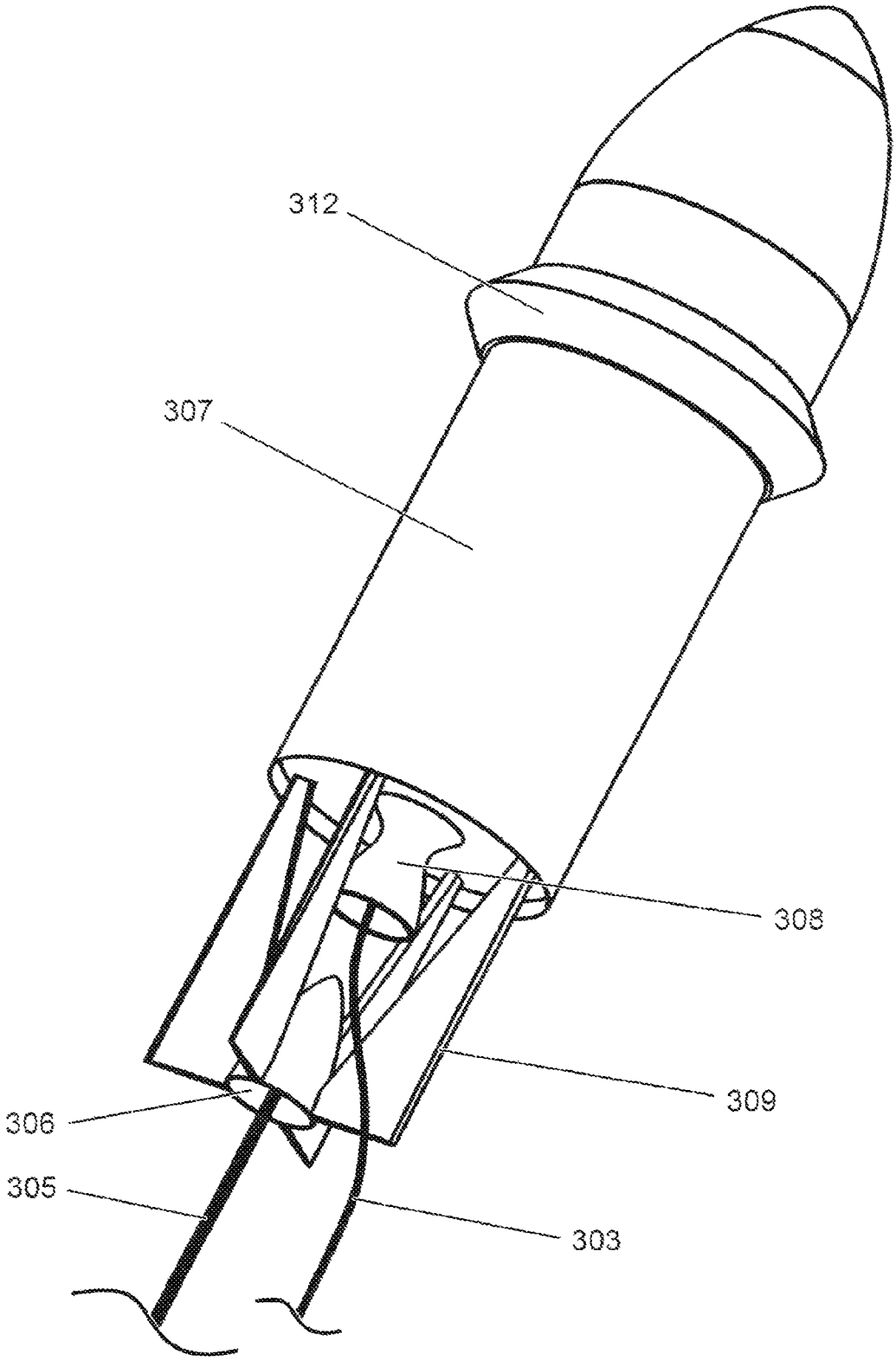
FIG. 12B is an enlarged diagrammatic view of a line tow rocket.

FIGS. 12, 12A and 12B depict construction details of miniature tow vehicles in orb assembly 300 (FIG. 5) that each pull a respective line from the orb. FIG. 12 shows a side view of micro solid rocket motor 307, which lies within a space of the micro solid rocket motor launch tube 313 in turn mounted within a respective orb (not shown). When launched, motor 307 departs the micro solid rocket motor launch tube 313 and orb assembly 300 (not shown), pulling a line, such as a sensor line 305, from reel 321. As described, these sensor lines are provided with one or more sensors, which may be acoustic, magnetic, electrical or pressure sensitive detectors. Such sensors may be mounted within or encased within the lines or may be mounted to an exterior of the lines and communicate electromagnetically to respective electromagnetic receivers within the lines. One example of underwater sensors on a line is shown in U.S. Pat. No. 9,137,599 at FIGS. 1a, 1b and accompanying description at col. 1 lines 45-53, which is incorporated herein by reference. However, while these sensors in the incorporated reference are disclosed as being slightly buoyant, Applicant's sensors would be configured to be neutrally buoyant. Also, it is disclosed in this incorporated portion that beam forming algorithms are used to identify, locate and track objects moving through the water. It is noted that a mix of types of lines may be used on any given orb. For instance, some of the lines may be sensor lines while others of the lines may be explosive or other countermeasure lines. Here, sensor lines may be in an orthogonal orientation about an orb, while other lines are explosive or countermeasure lines.

A line reel 321 (FIG. 12A), one line reel for each line, holds the lines before they are deployed and is mounted within a reel housing 304 at a reel axis 322 about which the reel rotates as a respective line is pulled off the reel. As noted, line 305 may be provided with sensors and a communications line or communications medium coupled to the sensors, and which in turn connects to processing circuitry for receiving the sensor signals and reacting to such signals. In a defensive orb, such reaction may be to trigger explosions when a threat is within range to be destroyed or disabled, or trigger emission of acoustic, electrical and magnetic countermeasures when the threat is further away so as to provide jamming signals. Here, one or more acoustic transducers, or "noisemakers" that mimic sounds emitted by a submarine, may be mounted to the orb to attract an incoming torpedo, or an antenna may be deployed on the orb or in the lines to emit electrical or magnetic signals or impulses that jam or fool sensors on an incoming torpedo and indicate that contact is about to occur. Where some of the cords are explosive, such explosive cords could be detonated to generate shock waves synchronized with emitted signals from the orb or lines that mimic impending contact with a submarine or other vessel's hull, which may cause a contact sensor in the torpedo to detonate the torpedo. In other embodiments, since torpedoes are typically detonated underneath surface vessels in order to break their keels, a magnetic or other signal may be generated either along or between lines by passing a surge of electrical current through the lines to simulate a torpedo being underneath a ship. In yet other embodiments, the orb may be deployed as or part of a sensor system. Signatures from a threat may be changes of pressure in the water around a sensor line, acoustic indications, electrical indications, magnetic indications and other sensible indications. In addition, the lines may include countermeasures such as an antenna or transducer for electrical emissions, magnetic emissions, acoustic jamming emissions or other emissions to disable a threat or fool it into exploding prematurely. In other embodiments, the line may be or include detonation cord suitable for underwater use, and which is triggered responsive to a proximate sensed threat that either enters the volume defined by the lines or is proximate the volume defined by the lines. In this instance, an explosive charge may also be placed within a respective orb, with the orb and explosive lines connected thereto all detonating at once responsive to a sensed threat. This would create a spherical volume within which multiple linear explosions occur, the volume being generally a diameter of twice the length of the respective lines extending from an orb, so given 12 lines where the lines are 50 feet long, the lines would define a spherical volume of a diameter of about 100 feet. With conventional detonation cord containing up to 200 grains or more per foot of either RDX or PETN, this would put up to about 17 pounds of RDX or PETN in a 100-foot explosion sphere of a single orb, and which is believed to be more than sufficient to disable, destroy or cause premature detonation of a torpedo that enters the explosion sphere. Notably, such a pattern of distributed, simultaneous linear explosions in a spherical configuration would create pressure waves that constructively and destructively interfere as they radiate outward that would create severe destructive buffeting of a torpedo that likely would destroy the torpedo or at least disrupt its sensors and communications. Of course, a similar charge may be located in an orb in addition to the detonation cord in the lines, to provide a more concentrated explosion or explosions in addition to explosions of the lines. In this example, it should be apparent that the orbs would be sized to contain the detonation cord, lines and associated mechanical and electrical components.

With the development of supercavitating torpedoes, which travel at a high rate of speed through the water in a bubble of gas created by cavitation, the explosion created in a spherical volume that the supercavitating torpedo enters may be sufficient to disrupt the cavitation bubble around the torpedo, causing the torpedo to contact the water around the bubble and create drag on the torpedo, disrupting its path and possibly causing its speed to fall below a speed at which cavitation is possible. Here, at least some supercavitating torpedoes are initially brought to speed by a rocket booster, after which a secondary rocket motor is used to maintain speed sufficient to maintain cavitation. Once the cavitation bubble is collapsed or disrupted, the secondary motor may not be able to allow the torpedo to again regain sufficient speed to once again become supercavitating. In addition, as at least one supercavitating torpedo uses a disc at the nose of the torpedo to generate the cavitation bubble and possibly steer the torpedo, a shock wave from exploding lines striking the nose of the torpedo may be sufficient to damage the disk, which would disrupt the path of the torpedo, possibly cause the torpedo to no longer maintain cavitation and possibly trigger a contact sensor, causing the torpedo to explode.

Sensors deployed in or along a line 305 would communicate with an orb control system 314 within a respective orb via a sensor umbilical cord 311 in order to sense a threat and cause to be deployed whatever countermeasures a particular orb is configured for. Where detonation cord is used to defeat a threat, a communications medium may be incorporated within the detonation cord, such as by way of example, that disclosed in US patent application no. US 20090159283, e.g. at FIGS. 4-6 and accompanying paragraphs 0015-0017 and 0020-0022, which are incorporated herein by reference. The communications medium would be attached to sensors in communicating relation disposed along the length of the detonation cord. As such, after the detonation cord with attached sensors is deployed into a relatively large spherical volume, such as the aforementioned 50 feet or more, pinpointing exact location of a threat entering or passing through the spherical volume should be relatively easy, for example using a loudest acoustic signal, strongest magnetic signal or a combination of both from one or more of the distributed sensors. Comparison logic may be used between sensors on different lines and between sensors on discrete lines to determine which sensor is registering a strongest signal in order to determine a best time to initiate detonation or other countermeasures. While detonation cord containing 200 grains of explosive per foot is disclosed, it should be apparent that lighter detonation cord may be used, such as detonation cord containing 50 grains of explosive per foot or even 25 grains per foot, depending on an amount of explosive found to be needed to neutralize a torpedo. It may be that simply disrupting the water by any weight of detonation cord is found to be sufficient to either jam or confuse homing sensors of a torpedo, cause it to explode or provide cover for a submarine to evade a torpedo. This was found to be the case during WWII where water was so disturbed by depth charges that sensors on a ship attacking a submarine were inoperable or blinded for up to 15 minutes, allowing the submarine to escape. Along these lines, detonation cord used in the instant invention may also be wrapped in a metallic foil or used in conjunction with metallic or magnetic foil to disperse chaff in the water in a spherical volume in front of an oncoming threat, causing predetonation or blinding of the threat. In this instance, detonation of the countermeasures device may occur immediately after or a short interval after deployment, depending on speed of the approaching torpedo. It is also apparent that the communications medium disclosed in US 20090159283 may be used in lines where sensors and radiating antenna are used. In other embodiments, flexible wires may be incorporated in the lines to connect sensors and/or antenna in the lines to sensing, control and countermeasures triggering circuitry.

As noted, the lines may comprise antenna for broadcasting electrical or magnetic signals for jamming, disabling, prematurely detonating or otherwise interfering with operation of the threat.

An initial command to activate and launch counter-torpedo system 100 (FIG. 5) is given through counter-torpedo system umbilical cord 301 (FIG. 7), and then via sensor line umbilical cord 311 (FIG. 12), which is connected to orb control system 314 through a sensor line umbilical cord plug in port 319. As shown in FIG. 12A, sensor line umbilical cord 311 is designated as 305, and which is wrapped uniformly around sensor line reel 321 as required to evenly and smoothly be pulled from the reel. Micro solid rocket motor 307 (FIG. 12) is activated via orb control system 314 via an ignition cord 303, through water tight ignition cord exit port 318 and connected to a water tight ignition cord plug in port 320. Micro solid rocket motor 307 is sealed in launch tube 313 via a seal 312 that fits into a threaded seal mount 316, which is sealed against the orb assembly 300 (not shown in this figure) with an o-ring or the like 317. Micro solid rocket motor 307 is connected to sensor line exhaust protection cone 306 as by cone supports 309 (FIGS. 12 and 12B), which protects sensor line 305 from hot exhaust gasses, and which is mounted to micro solid-rocket motor 307 at sensor line mounting point 310. In one embodiment, orb control system 314 receives commands via counter-torpedo system umbilical cord 301 and passes fire commands through fire control system umbilical cord 216, which can be either inputs by a user or set as an automatic reaction to an incoming threat. The orb receives its power through orb power storage system umbilical cord 323, which is connected to an orb power storage system (not shown), which may be a battery or other electrical storage or electrical power generating device.

FIG. 12B depicts a perspective view of an unfired micro solid-rocket motor 307. Motor 307 is shown with an exhaust nozzle 308 (FIGS. 12 and 12B) mounted at its aft bottom section, which accepts ignition cord 303 and allows expansion of hot exhaust of the ignited solid propellant powering the motor. Exhaust shield 306 is disposed to protect line 305, which also may be hardened against exhaust gasses for at least a portion of a downstream length of line 305 from motor 307 that otherwise be exposed to exhaust gasses. When a command is given to launch micro solid-rocket motor 307, seal 312 is broken as the micro solid-rocket motor leaves the micro solid-rocket motor launch tube 313 (FIG. 12A) pulling line 305 from reel 321 to its fully extended position (item 400, deployed orb). Once line 305 is fully extended, rocket 307 is released from line 305 by a line release event, such as a pre-set breakaway pull strength design. Where detonation cord is used as a sensor line, a terminal portion thereof may be of another material, such as a rope or plastic line, so that breaking or cutting the line does not initiate ignition of the detonation cord or wet the cord. As detonation cord is rather substantial, having a breaking strength of from about 50 lbs to about 200 lbs, release of a rocket from the detonation cord by a line releaser may be accomplished simply by the terminal portion that is attached to a respective tow rocket being of a line portion selected to be of a lessor breaking strength than the breaking strength of the detonation cord. For example, where a breaking strength of detonation cord is 50 lbs, and with one end of the line or detonation cord anchored to a respective reel in an orb, a terminal, opposite line releaser end portion thereof that is attached to a tow rocket might be a terminal line portion selected to break at 10 to 20 lbs tension, depending on how much drag is applied on the line in order to pull it from a respective reel and through the water. Of course, thrust of a tow rocket must be selected to be greater than the breaking strength of the terminal portion of line, such as 20-40 lbs or so of thrust in the given example. In other embodiments, the terminal portion of the line or detonation cord may be cut by a line releaser, as by a cutter incorporated in a tow rocket and operated by the line snapping taut when its full length is reached. Such a cutter may simply be a fixed cutting blade against which the line is pulled when snapped taut, a spring-loaded blade that is released when the line is snapped taut or a blade attached to a lever in turn attached to the line, the lever being pivoted to cut the line when the line is snapped taut. A scissors-type cutter using two blades, one attached to the line and one fixed, to cut the line may also be employed. The tow rockets for the line/detonation cords are provided with sufficient fuel to continue some distance, such as 20-50 feet or so, after their release. This assures that the line towing rockets are sufficiently fueled to pull their lines into a fully extended position, and may aid in disrupting an incoming threat by creating a field of spent rocket bodies the incoming threat might strike and be caused to prematurely explode, particularly in the instance of a supercavitating torpedo, or the spent rocket bodies may be magnetically active, as by being ferrous or even magnetized, so as to be detected magnetically and cause a premature explosion of an incoming torpedo. In an aerial embodiment where an orb is deployed in front of an oncoming missile, it is anticipated that the line tow rockets would need to be more powerful due to a countermeasures body being deployed at a high speed and the need to pull the lines out to their full extent in the instant after being launched and before encountering a missile.

Figure 13:
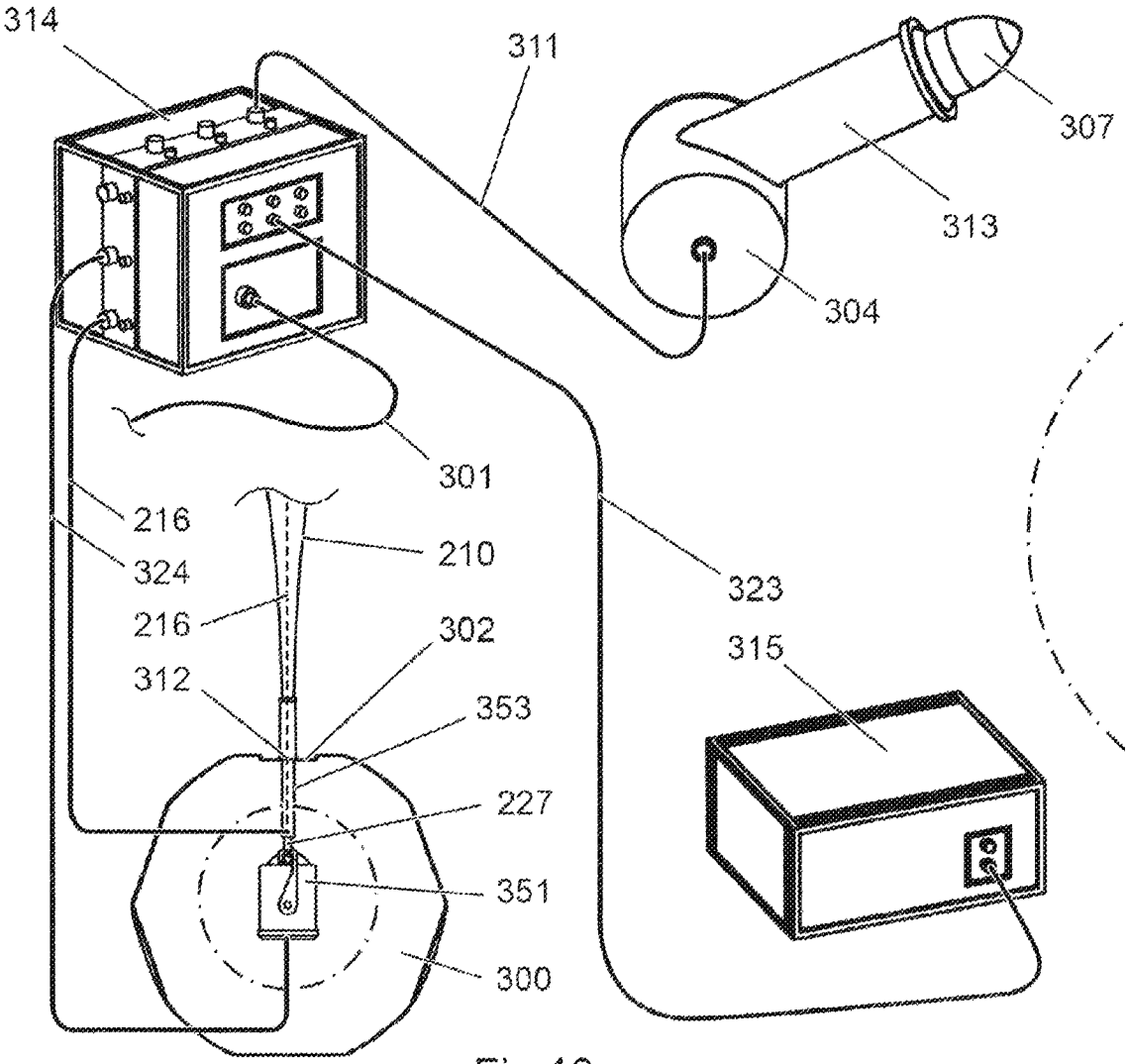
FIG. 13 is a diagrammatic view of connections of an orb control system, a power source and a launch tube for a line tow rocket.

FIG. 13 and FIG. 13A, by way of example, show how a deploying orb may be released from its respective tow rocket. Exhaust spike 210 is mounted to orb body assembly 302 through orb assembly mounting point 350 (FIG. 11A) and its seal 312, through exhaust nozzle locking rod support tube 353 (FIG. 13A) by exhaust nozzle locking rod 227. At a tip of exhaust locking rod 227 of exhaust spike 210 is a lock notch 352, which is captured by exhaust spike lock/release mechanism 351, specifically by exhaust spike lock/release arms 351*a*, with commands traveling through exhaust spike lock/release mechanism umbilical cord 324 (FIGS. 12, 13, and 13A). FIG. 13 shows orb control system 314 mounted within an orb 300) connected directly to exhaust spike lock/release mechanism 351 via exhaust spike lock/release mechanism electrical umbilical cord 324 (FIGS. 12, 13, and 13A), and to sensor line reel housing 304 via sensor line umbilical cord 311, which launches micro solid-rocket motor 307 from launch tube 313. Orb control system 314 is powered by orb power storage system 315 (also within an orb 300) via orb power storage system umbilical cord 323 and receives its launch command from a respective submarine's detection and identification system automatically, or by the submarine crew via the counter-torpedo system umbilical cord 301. Fire control umbilical cord 216 is routed through the exhaust spike 210 and conveys a signal to ignite or otherwise start a tow vehicle 200 (FIG. 5). Of course, other embodiments of orbs may omit tow rockets, and simply be released from a moving submarine and deploy their respective tow motors and lines after a predetermined period of time.

Figure 13B:
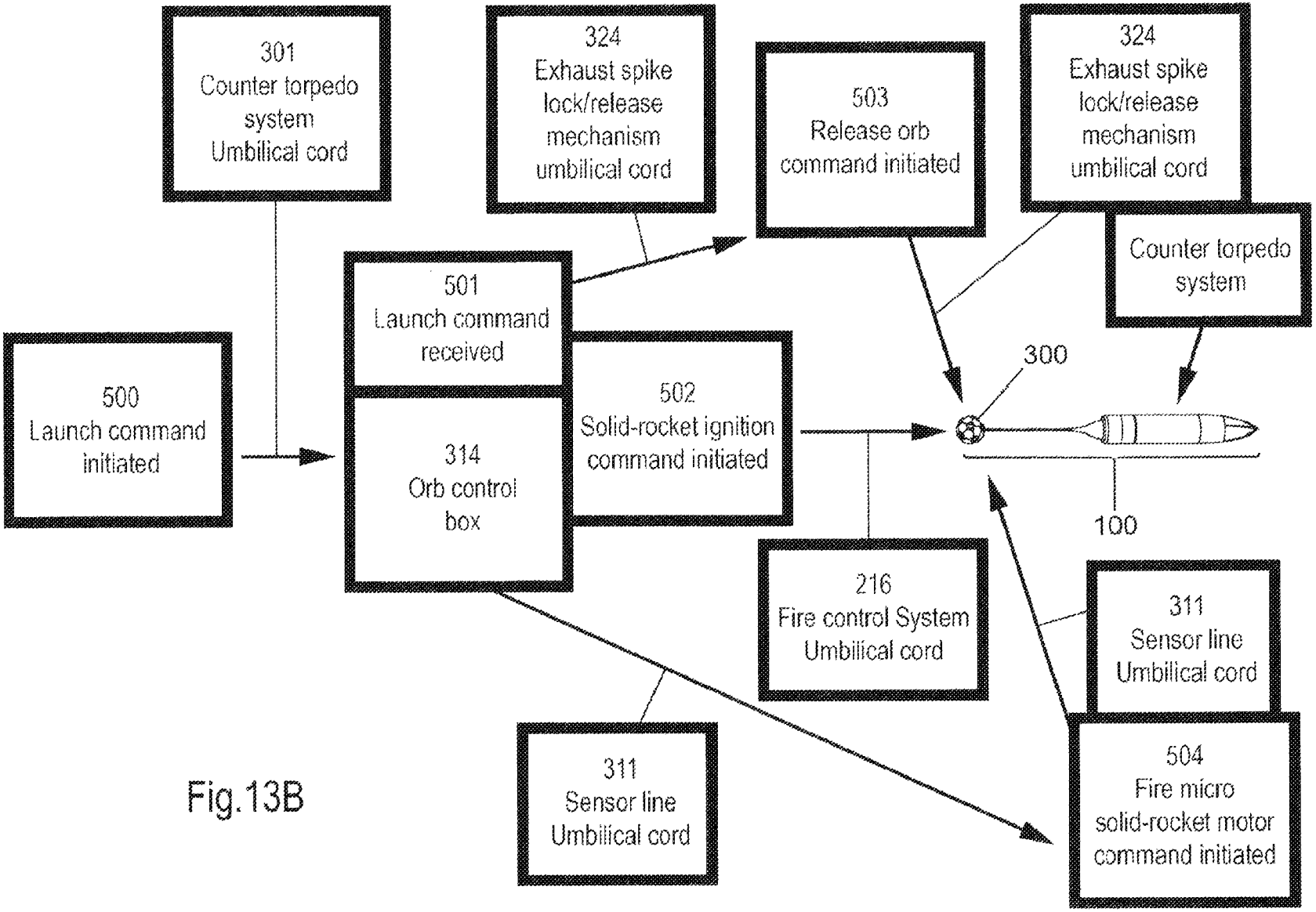
FIG. 13B is a block diagram example of operation of the countermeasures system.

FIG. 13B depicts the process and command paths for activating the counter-torpedo system 100. At box 500 a launch command is initiated either manually by the crew, or through other on-board autonomous sensor systems of a submarine or other vessel or vehicle. Once a launch command is initiated, the signal to launch travels through the countermeasures system umbilical cord 301 to the orb control box 314 and is received at box 501. Solid-rocket ignition or other start command is initiated at box 502, which sends a command through fire control system umbilical cord 216 to ignite tow vehicle 200 (FIG. 1). After being towed to a predetermined location, a "release orb" command is transmitted at box 503 through exhaust spike lock/release mechanism umbilical cord 324, sending a command that tells the counter-torpedo system 100 when to release orb assembly 300. After the orb is halted in its forward momentum by drag in the water, typically a few seconds, such as 5 seconds or less due to the generally non-streamlined spherical shape of the orb, micro solid-rocket motor commands are given at box 504 via sensor line umbilical cord 311 to simultaneously fire the rockets from the orb and deploy their respective lines. A defensive orb would then wait for a threat to move within a predetermined distance, or within a spherical volume defined by the extent of deployed lines. An orb designed for sensing would simply remain stationary in the water or be carried by current where an orb designed for longer term missions is deployed.

It is noted that in some embodiments the orbs with extended sensor, antenna or detonation cord lines may comprise buoyancy control so that they may remain at any selected depth, at least to intercept a threat. Such a buoyancy control device, for example only, may be any of the embodiments found in U.S. Pat. No. 8,397,658, particularly at FIGS. 5-14 and accompanying discussions beginning at col. 4 line 58 through col. 11 line 52, which is incorporated herein by reference. Other buoyancy control systems may also be used.

It is also noted that it is important for the extended lines to remain at their extended state and at their relative location to define a generally spherical volume. Where a defensive orb is deployed to destroy or disable a threat, such as an incoming torpedo or the like, and which will be used at most for the time it takes for the threat to reach at least within a range of transmitted electrical or magnetic countermeasures or within a range of any explosives in or on the lines and orb, it may be sufficient simply to configure the lines to be neutrally buoyant so that they maintain their position for such period of time that an oncoming threat is viable. In the instance of supercavitating torpedoes and a threatened submarine or ship, a threat period may only last for 15 to 20 minutes or so. In other instances where a conventional torpedo is the oncoming threat, the threat period may be up to an hour or more, depending on the fuel reserves of the torpedo. This may be done by a careful selection of materials the lines are constructed of in order to make them neutrally buoyant, or by the addition of material to the lines to keep the lines extended and in position. Such material may be in the form of strands incorporated in the lines that are selected so as to make the lines neutrally buoyant. In other embodiments, the lines may each have incorporated therein a thin strand of spring material, such as spring steel, that is normally straight, but which may be wound on a reel with the line. Here, the lines would be attached perpendicular to an orb so that they extend outward generally normal to a surface of the orb as biased by the spring strand to define a sphere around the orb. In another embodiment of a stiffener, a coil of flat, thin metal tape may be preconfigured to have a curl running longitudinally along the tape, similar to a pocket tape measure, so that when unwound the tape curls about its axis into at least a semicircle or even a tube to form a more permanent rigid stiffener that would maintain its position relative to the sphere indefinitely until some untoward event causes destruction of the sphere or tapes. In this embodiment the tape itself may carry an explosive line, sensor line or countermeasures broadcasting line, and may be attached to a respective rocket motor for unrolling the tape. In these embodiments using a tape or flexible strand material, the tape or strand may be deployed without a rocket motor. Instead, the reel may simply be turned by a motor that unrolls the line, which would automatically straighten by itself, In other embodiments, the tape itself would be the line. In yet another embodiment, a substance such as sodium polyacrylate, or other similar substance, that absorbs water and turns into a gel or otherwise hardens may be used in tubes that form the lines, the tubes having small perforations or otherwise configured to leak therealong such that when extended, the tubes become rigid due to the sodium polyacrylate absorbing water that leaks into the tubes. In yet other embodiments, the lines may be tubes that are pressurized with water by a small pump in an orb the tubes are attached to. In these embodiments where some sort of pressurized tube or straw forms the lines, the tubes would be rolled flat on their respective reels, conserving space. In a satellite defensive orb, such tubes that form the lines would be sealed, and may be expanded after being deployed from an orb to define a spherical volume by pressurizing the tubes with one or more small reservoirs of gas responsive to deployment of the defensive orb. The term "generally normal to the orb" is intended to mean that the line or lines are generally coaxial with or aligned with a center of the orb. The term "generally" is used with respect to the position of the lines because the lines, whether with or without a stiffener, may deviate somewhat from normal with respect to the sphere, perhaps on the order of 20% or so, due to ocean currents or other disturbances in the water or other medium, or movement of the orb and lines while being deployed. In embodiments having a stiffener in the lines, either the reel a line (or tape) is wound about is locked in place after the line is fully extended so that a line extends therefrom generally normal to a surface of the orb, or the line may be attached to the orb and normal to the orb and released from the reel after being fully extended. These embodiments should be suitable for relatively long-term use in sensing applications or may be used in defensive applications. As should be apparent, computer control may be added to such orbs so that the orb may be brought near the water surface periodically or responsive to a stimulus to expose a portion of one of the lines that serves as a transmitting/receiving antenna. Such an antenna may need to be only a few inches or less in length depending on a transmission/receiving frequency used. Here, this particular line having an antenna portion at the end thereof may be provided with a small buoy at the base of the antenna portion that maintains that line in a vertical orientation by applying a small torque to the orb to maintain its orientation in the water. Such a small buoy may simply be a bubble within the line of a size sufficient to pull the line into a vertical orientation in the water in order for the antenna to extend above a water surface when needed.

While specific embodiments and components have been described, it is apparent that different modalities of the invention exist in various combinations of the described components. All these differing combinations of the described components are to be considered as being encompassed by the disclosed invention.

Having thus described my invention and the manner of its use, it should be apparent to those skilled in the relevant arts that incidental changes may be made thereto that fairly fall within the scope of the following appended claims, wherein I claim:

1. A system for protecting an asset above a surface of Earth from an oncoming threat, the system comprising:

a body, a plurality of lines in the body so that when the plurality of lines are extended, the plurality of lines extend outward from the body in directions therefrom to define a generally spherical volume that the plurality of lines extend through, a plurality of line deployment mechanisms in the body, each line deployment mechanism of the plurality of line deployment mechanisms connected to one end of a respective one of the plurality of lines, the plurality of line deployment mechanisms configured so that when activated, the plurality of line deployment mechanisms each deploy a respective said line of the plurality of lines from the body in the directions to define the generally spherical volume above a surface of Earth, a communications medium in at least some of the plurality of lines, at least one sensor connected to the communications medium in a respective said line of the at least some of the plurality of lines, for sensing the oncoming threat, At least one defense mechanism responsive to the at least one sensor within the generally spherical volume, A launcher for deploying the body to a predetermined location above a surface of Earth where the plurality of lines including the at least one sensor are deployed in the generally spherical volume to defeat the oncoming threat.

2. The system as set forth in claim 1 wherein the launcher further comprises a rocket motor, for towing the body to the predetermined location in front of the oncoming threat.

3. The system as set forth in claim 2 wherein the plurality of line deployment mechanisms are rocket motors, for pulling the lines from the body.

4. The system as set forth in claim 3 wherein the at least one sensor is at least one of a magnetic sensor, an electrical sensor and a pressure sensor.

5. The system as set forth in claim 1 wherein the at least one defense mechanism comprises at least some of the lines of the plurality of lines being explosive lines responsive to signals from the at least one sensor.

6. The system as set forth in claim 1 wherein the plurality of lines are configured to maintain their position and orientation after deployment so that the generally spherical volume defined by the lines is maintained.

7. The system as set forth in claim 6 wherein the plurality of lines each further comprises a stiffener, for maintaining the position and the orientation of the plurality of lines after the plurality of lines are deployed.

8. The system as set forth in claim 6 further comprising a receiver in the body, the receiver connected to the communications medium of the at least one sensor, for receiving signals related to the oncoming threat from the at least one sensor.

9. The system as set forth in claim 8 further comprising countermeasures broadcaster in the body and coupled to the at least some of the plurality of lines, for broadcasting countermeasures to the oncoming threat responsive to the at least one sensor.

10. The system of claim 9 wherein the countermeasures broadcaster is configured to broadcast at least one of an EMF discharge and an electrical signal.

11. A tube launched countermeasures system comprising:

a plurality of launch tubes, each launch tube of the plurality of launch tubes containing a discrete countermeasure system, each discrete countermeasure system further comprising:

a body, a body tow rocket motor for towing the body to a predetermined deployment point, the body tow rocket motor configured to release the body at the predetermined deployment point, a plurality of extendable lines within the body, the plurality of extendable lines each coupled at one end to the body at points selected such that when the plurality of extendable lines are extended straight out from the body, the plurality of extendable lines are within a generally spherical volume defined by the plurality of extendable lines, a plurality of line tow rocket motors in the body, each line tow rocket motor of the plurality of line tow rocket motors attached to an opposite end of a respective extendable line of the plurality of extendable lines, for towing the plurality of extendable lines into an extended position in order to define the generally spherical volume at the predetermined deployment point, one or more sensors on respective ones of the plurality of extendable lines, for sensing signals or disturbances in or around the generally spherical volume, A defense mechanism in the generally spherical volume and responsive to the one or more sensors, for implementing countermeasures.

12. The tube launched countermeasures system as set forth in claim 11 wherein the plurality of extendable lines are configured to maintain their position and orientation such that the generally spherical volume defined by the plurality of extendable lines is maintained.

13. The tube launched countermeasures system as set forth in claim 12 further comprising a communications medium in each said extendable line of the plurality of extendable lines, one or more communications medium connected to a respective one of the one or more sensors on a respective said one or more said extendable line.

14. The tube launched countermeasures system as set forth in claim 13 wherein at least some of the extendable lines of the plurality of extendable lines are explosive extendable lines configured to explode responsive to signals from the one or more sensors.

15. The tube launched countermeasures system as set forth in claim 12 further comprising at least one transmitter in the body, for broadcasting at least one of an EMF discharge and an electrical jamming signal.

16. A method for countering an oncoming threat comprising:

selecting a location in front of the oncoming threat, using a plurality of lines, defining a generally spherical volume at the location in front of the oncoming threat, sensing the oncoming threat, using the lines for activating countermeasures within the generally spherical volume responsive to the sensing the oncoming threat.

17. The method as set forth in claim 16 wherein the activating countermeasures further comprises triggering one or more explosive charges within the generally spherical volume when the oncoming threat is within the generally spherical volume.

18. The method as set forth in claim 16 wherein the activating countermeasures further comprises emitting jamming signals from within the spherical volume and in front of the oncoming threat.

19. The method as set forth in claim 16 wherein the activating countermeasures further comprises emitting EMF discharges when the sensed said oncoming threat is near or within the generally spherical volume.

* * * * *